US008209916B2

(12) United States Patent
Herron

(10) Patent No.: US 8,209,916 B2
(45) Date of Patent: Jul. 3, 2012

(54) CONSTRUCTION BLOCK

(75) Inventor: Burke A. Herron, Fort Thomas, KY (US)

(73) Assignee: Global Shelter Systems, Inc., Fort Thomas, KY (US)

( * ) Notice: Subject to any disclaimer, the term of this patent is extended or adjusted under 35 U.S.C. 154(b) by 492 days.

(21) Appl. No.: 12/505,956

(22) Filed: Jul. 20, 2009

(65) Prior Publication Data

US 2010/0326001 A1 Dec. 30, 2010

Related U.S. Application Data

(60) Provisional application No. 61/082,393, filed on Jul. 21, 2008.

(51) Int. Cl.
*E04H 1/00* (2006.01)
*B65D 8/18* (2006.01)
*A63H 33/08* (2006.01)

(52) U.S. Cl. ..... 52/79.5; 52/71; 405/15; 220/4.28; 220/4.33; 446/108; 446/112

(58) Field of Classification Search ..... 52/70, 71, 52/79.5, 604, 606, 284, 646, 503, 565, 582.1, 52/592.6, 192, 197; 405/110, 111, 15–17, 405/31, 114, 284; 206/509, 508, 507, 505, 206/504; 220/7, 6, 4.34, 4.33, 4.29, 4.28, 220/66, 23.86, 23.83, 23.6, 23.4; 428/12; 446/85, 108, 109, 111, 112, 115, 117, 122, 446/123, 478

See application file for complete search history.

(56) References Cited

U.S. PATENT DOCUMENTS

| | | | |
|---|---|---|---|
| 1,198,524 | A | 9/1916 | Cunliffe |
| 1,634,357 | A | 7/1927 | Himmelright |
| 1,828,088 | A | 10/1931 | Robinson |
| 1,883,553 | A | 10/1932 | Chain |

(Continued)

FOREIGN PATENT DOCUMENTS

| | | |
|---|---|---|
| CA | 30626 | 6/1968 |

(Continued)

OTHER PUBLICATIONS

Notice of Allowance and Fee(s) Due, and related documents, having a Notification Date of Mar. 29, 2010, U.S. Appl. No. 11/945,820, Titled: "Construction Block", filed Nov. 27, 2007, Inventor: Burke A. Herron, 23 pages.

(Continued)

*Primary Examiner* — Robert Canfield
*Assistant Examiner* — Babajide Demuren
(74) *Attorney, Agent, or Firm* — Ulmer & Berne LLP

(57) ABSTRACT

A construction block includes a pair of base members and a pair of side wall assemblies. Each base member defines first and second upper channels and comprises a first plurality of ribs positioned within the first upper channel and a second plurality of ribs positioned within the second upper channel. Each side wall assembly defines a hollow load chamber having an open top and an open bottom and includes a plurality of hingedly interconnected panels, each including a thermoplastic material. A first side wall assembly is releasably engaged with at least some of the first plurality of ribs of a lower one of the base members, and a second side wall assembly is releasably engaged with at least some of the second plurality of ribs of the lower one of the base members. Each side wall assembly is releasably engaged with an upper one of the base members.

20 Claims, 21 Drawing Sheets

U.S. PATENT DOCUMENTS

| | | | |
|---|---|---|---|
| 2,241,169 | A | 5/1941 | Yokes |
| 2,319,641 | A | 5/1943 | Speir, Jr. |
| 2,610,503 | A | 9/1952 | Hall |
| 2,826,906 | A | 3/1958 | Rice |
| 3,030,093 | A | 4/1962 | Reintjes |
| 3,246,828 | A | 4/1966 | Branscum et al. |
| 3,250,564 | A | 5/1966 | Stern et al. |
| 3,495,705 | A | 2/1970 | Limbacher |
| 3,697,633 | A | 10/1972 | Edgar |
| 3,886,751 | A | 6/1975 | Porraz Jimenez Labora |
| 3,922,832 | A | 12/1975 | Dicker |
| 3,957,098 | A | 5/1976 | Hepworth et al. |
| 4,050,254 | A | 9/1977 | Meheen et al. |
| 4,240,565 | A | 12/1980 | Croley |
| 4,421,253 | A | 12/1983 | Croley |
| 4,440,296 | A | 4/1984 | Howe et al. |
| 4,443,911 | A | 4/1984 | Bannister |
| 4,491,231 | A | 1/1985 | Heggeland et al. |
| 4,650,368 | A | 3/1987 | Bayer |
| 4,673,087 | A | 6/1987 | Webb |
| 4,765,252 | A | 8/1988 | Shuert |
| 4,782,972 | A | 11/1988 | Wenkman et al. |
| 4,850,260 | A | 7/1989 | Walker et al. |
| 4,905,409 | A | 3/1990 | Cole |
| 4,918,765 | A | 4/1990 | Harding |
| 4,918,786 | A | 4/1990 | Perry |
| 4,965,979 | A | 10/1990 | Larrivee et al. |
| 5,046,789 | A | 9/1991 | Lee |
| 5,161,709 | A | 11/1992 | Oestreich, Jr. |
| 5,168,678 | A | 12/1992 | Scott, Jr. et al. |
| 5,199,589 | A | 4/1993 | Noble |
| 5,333,970 | A | 8/1994 | Heselden |
| 5,351,846 | A | 10/1994 | Carter |
| 5,472,297 | A | 12/1995 | Heselden |
| 5,513,475 | A | 5/1996 | Schaaf et al. |
| 5,538,178 | A | 7/1996 | Zink et al. |
| 5,564,599 | A | 10/1996 | Barber et al. |
| 5,647,695 | A | 7/1997 | Hilfiker et al. |
| 5,720,161 | A | 2/1998 | Liedgens |
| 5,740,648 | A | 4/1998 | Piccone |
| 5,829,595 | A | 11/1998 | Brown et al. |
| 5,899,337 | A | 5/1999 | Thebeault |
| 5,988,946 | A | 11/1999 | Reed |
| 6,022,172 | A | 2/2000 | Siyaj |
| 6,024,223 | A | 2/2000 | Ritter |
| 6,086,444 | A | 7/2000 | Glickman |
| 6,219,984 | B1 | 4/2001 | Piccone |
| 6,241,148 | B1 | 6/2001 | Schwimmer |
| 6,299,011 | B1 | 10/2001 | Rosenfeldt |
| 6,334,736 | B1 | 1/2002 | Johnson et al. |
| 6,428,240 | B1 | 8/2002 | Ehrlich et al. |
| D466,229 | S | 11/2002 | Risi et al. |
| 6,477,814 | B1 | 11/2002 | Kadosh |
| 6,619,884 | B2 | 9/2003 | Davis et al. |
| 6,631,603 | B2 | 10/2003 | Zornes |
| 6,672,799 | B2 | 1/2004 | Earl |
| 6,715,960 | B2 | 4/2004 | Metz |
| 6,783,058 | B2 | 8/2004 | Quaintance |
| 6,935,075 | B2 | 8/2005 | Sherman |
| 6,935,085 | B2 * | 8/2005 | Little, Jr. ..... 52/762 |
| 7,413,081 | B2 | 8/2008 | Rogers |
| 7,419,330 | B2 | 9/2008 | Heselden |
| 7,530,763 | B2 | 5/2009 | Heselden |
| D597,680 | S | 8/2009 | Heselden |
| D611,613 | S | 3/2010 | Heselden |
| 7,765,744 | B2 | 8/2010 | Herron |
| 7,941,976 | B2 | 5/2011 | Herron |
| 2002/0170844 | A1 | 11/2002 | Stone et al. |
| 2005/0055980 | A1 | 3/2005 | Muise |
| 2006/0005497 | A1 | 1/2006 | Foell et al. |
| 2006/0032172 | A1 | 2/2006 | Foell et al. |
| 2006/0219593 | A1 | 10/2006 | Linz |
| 2006/0237455 | A1 | 10/2006 | Vargas |
| 2006/0254947 | A1 | 11/2006 | Rogers |
| 2006/0277867 | A1 | 12/2006 | Holgesson |
| 2007/0154265 | A1 | 7/2007 | Stauffacher et al. |
| 2007/0160423 | A1 | 7/2007 | Heselden |
| 2008/0095579 | A1 | 4/2008 | Heselden |
| 2008/0155929 | A1 | 7/2008 | Herron |
| 2008/0156683 | A1 | 7/2008 | Heselden |
| 2008/0159814 | A1 | 7/2008 | Heselden |
| 2008/0237078 | A1 | 10/2008 | Heselden |
| 2008/0247830 | A1 | 10/2008 | Heselden |
| 2008/0279634 | A1 | 11/2008 | Heselden |
| 2008/0283106 | A1 | 11/2008 | Heselden |
| 2009/0080975 | A1 | 3/2009 | Heselden |
| 2009/0090647 | A1 | 4/2009 | Panchal et al. |
| 2009/0185871 | A1 | 7/2009 | Heselden |
| 2009/0202308 | A1 | 8/2009 | Heselden |
| 2010/0008726 | A1 | 1/2010 | Heselden |
| 2010/0032333 | A1 | 2/2010 | Heselden |
| 2010/0064627 | A1 | 3/2010 | Heselden |
| 2010/0072101 | A1 | 3/2010 | Heselden |
| 2010/0086366 | A1 | 4/2010 | Heselden |
| 2010/0092251 | A1 | 4/2010 | Heselden |
| 2011/0179745 | A1 | 7/2011 | Herron |

FOREIGN PATENT DOCUMENTS

| | | | |
|---|---|---|---|
| CA | 64304 | | 4/1989 |
| CA | 2155082 | | 2/1997 |
| CA | 2184948 | | 3/1998 |
| CA | 2440923 | | 3/2005 |
| DE | 69023493 | T2 | 4/1996 |
| EP | 0620326 | A1 | 10/1994 |
| EP | 0647739 | A1 | 4/1995 |
| EP | 0466726 | B1 | 8/1995 |
| EP | 1713981 | A1 | 10/2006 |
| GB | 2270938 | A | 3/1994 |
| GB | 2375777 | A | 11/2002 |
| GB | 2375777 | B | 1/2005 |
| GB | 2423107 | A | 8/2006 |
| GB | 2432610 | A | 5/2007 |
| GB | 2432611 | A | 5/2007 |
| GB | 2438204 | A | 11/2007 |
| GB | 2441028 | A | 2/2008 |
| IN | 180060 | | 1/1998 |
| NO | 913881 | | 10/1991 |
| NO | 301896 | | 12/1997 |
| RU | 2073085 | | 2/1997 |
| WO | 9012160 | A1 | 10/1990 |
| WO | 0040810 | | 7/2000 |
| WO | 2005080691 | A1 | 9/2005 |
| WO | 2005114966 | A1 | 12/2005 |
| WO | 2006122290 | A2 | 11/2006 |
| WO | 2007060475 | A1 | 5/2007 |
| WO | 2007060476 | A1 | 5/2007 |
| WO | 2007135352 | A1 | 11/2007 |
| WO | 2008020247 | A1 | 2/2008 |
| WO | 2008/076305 | | 6/2008 |

OTHER PUBLICATIONS

Supplemental Notice of Allowability, and related documents, having a Notification Date of May 26, 2010, U.S. Appl. No. 11/945,820, Titled: "Construction Block", filed Nov. 27, 2007, Inventor: Burke A. Herron, 4 pages.

Supplemental Notice of Allowability, and related documents, having a Notification Date of Jun. 22, 2010, U.S. Appl. No. 11/945,820, Titled: "Construction Block", filed: Nov. 27, 2007, Inventor: Burke A. Herron, 4 pages.

U.S. Appl. No. 12/828,630, Titled: "Construction Block", filed Jul. 1, 2010, Inventor: Burke A. Herron, in its entirety.

Notice of Allowance and Fee(s) Due, and related documents, having a Notification Date of Sep. 7, 2010, U.S. Appl. No. 12/828,630, Titled: "Construction Block", filed Jul. 1, 2010, Inventor: Burke A. Herron, 29 pages.

RAID: Ballistic Resistant Panel System. Retrieved from the Internet: <URL:www.dynasystems.co.uk/V3/set4_a.htm> 4 pages. Known to have been in the public domain at least as early as Jun. 24, 2009.

RAID-T Modular Wall and Roof Panel System. Retrieved from the Internet: <URL:www.dynasystems.co.uk/V3/set4_b. htm> 3 pages. Known to have been in the public domain at least as early as Jun. 24, 2009.

Rapid Deployed Armour Infantry DYN-E-Post. Retrieved from the Internet: <URL:www.dynasystems.co.uk/V3/pdfs/RAID.pdf> 1 page. Known to have been in the public domain at least as early as Jun. 24, 2009.
Rapid Deployed Armour Infantry DYN-E-Post Tower. Retrieved from the Internet: <URL:www.dynasystems.co.uk/V3/pdfs/RAID_T.pdf> 1 page. Known to have been in the public domain at least as early as Jun. 24, 2009.
International Preliminary Report on Patentability, 12 pages, International Application No. PCT/US2007/025489, issued on Jun. 16, 2009.
Dynablok Blast and Ballistic Protective Walling System Brochure. Retrieved from the Internet: <URL:www.dynablok.net/pdf/dynablokbrochure.com> 2 pages. This brochure is known to have been in the public domain at least as early as Jun. 7, 2009.
Angleblock; http://www.angleblock.com; date obtained: Nov. 28, 2007; p. 1 of 1.
Blast Mitigation Action Group (BMAG); "Wall Products"; Copyright 2002 USACE (remainder of copyright identification not legible); https://bmag.usace.army.mil/wall-products.php; 12 pages.
Blastgard International; "Protecting Lives & Precious Assets"; Copyright 2006 Blastgard International, Inc.; http://www.blastgardintl.com/bp-blastwrap.asp; 2 pages.
Blastgard International; "Unique Aspects of Blastwrap"; Copyright 2006 Blastgard International, Inc.; http://www.blastgardintl.com/td_aspects.asp; 2 pages.
Corrugated Metals, Inc.; "Metalith™ Perimeter Security Barrier Walls"; Copyright 2000-2008 Corrugated Metals, Inc.; http://www.corrugated-metals.com/metalith.html; 5 pages.
Infrastructure Defense Technologies; "Metalith™ Perimeter Security Barrier Walls"; Copyright 2003-2008 Infrastructure Defense Technologies; http://www.themetalith.com/products.html; 4 pages.
Infrastructure Defense Technologies; "The Metalith™: Cost Effective K12 Certified Perimeter Security Barriers"; Copyright 2003-2007 Infrastructure Defense Technologies; http://www.themetalith.com; 2 pages.
Infrastructure Defense Technologies; "The Metalith™ Protective Barrier System"; Copyright 2005-2008 Infrastructure Defense Technologies; http://www.infrastructure-defense.com/products-metalith.html; 1 page.
U.S. Army Corps of Engineers: Engineer Research and Development Center; "SACON® Shock-Absorbing Concrete"; Date Obtained: Feb. 2008; http://www.erdc.usace.army.mil; 2 pages.
Hesco Bastion USA, LLC; "Corporate Handbook, Guide for Hesco Bastion Concertainers"; Jan. 1, 2004; 12 pages.
Heselden, James, Gabion, Australian Publication No. AU 2006/318824, published on May 31, 2007 (abstract).
Heselden, James, Improvements Relating to Building and Shoring Blocks, Canadian Patent No. CA 2056454, issued Jul. 3, 2001 (abstract).
Heselden, James, Building and Shoring Blocks, Croatian Publication No. HR 940474, published on Aug. 31, 1996.
Heselden, James, Gabion or Alternative Concrete Block Formwork, Portugal Publication No. PT 101503, published on Nov. 8, 1995 (abstract).
Heselden, James, Building and Support Block and Method of its Production, Slovakian Publication No. SK 42494, published on Nov. 8, 1995.
Heselden, James, U.S. Appl. No. 12/090,352, filed: Apr. 15, 2008 (not published).
Heselden, James, U.S. Appl. No. 12/090,648, filed May 14, 2008 (not published).
International Search Report and Written Opinion of the International Searching Authority, International Application No. PCT/US2007/025489, mailed on Jul. 23, 2008.
Office Action and Form PTO-892, Notification Date of Jun. 23, 2011, U.S. Appl. No. 13/081,681, Titled: Construction Block, filed Apr. 7, 2011, Inventor: Burke A. Herron, 39 pages.
Notice of Allowance and Fee(s) Due; Date Mailed: Dec. 7, 2011; U.S. Appl. No. 13/081,681; Applicant: Burke A. Herron, filed Apr. 7, 2011; Titled: "Construction Block"; 25 pages.
Preliminary Amendment for U.S. Appl. No. 13/081,681, Titled: "Construction Block", Applicant: Burke A. Herron; Filed with U.S. Appl. No. 13/081,681, on Apr. 7, 2011; 13 pages. U.S. Appl. No. 13/081,681 is a divisional application of U.S. Appl. No. 11/945,820, issued as U.S. Patent No. 7,765,744 on Aug. 3, 2010, which was disclosed in an Information Disclosure Statement filed on Sep. 24, 2010 for the captioned application.
Notice of Allowance and Fees Due; Date Mailed Sep. 7, 2010, U.S. Appl. No. 12/828,630, Applicant Burke A. Herron, filed Jul. 1, 2010, Titled Construction Block; 28 pages.
Examination Report under Section 18(3), dated Oct. 7, 2010, issued by the United Kingdom Intellectual Property Office for United Kingdom Patent Application No. GB 0909465.7, 5 pages.
Petition to Withdraw from Issue Under 37 C.F.R. § 1.313(c)(2) submitted to the U.S. Patent and Trademark Office on Dec. 23, 2010; U.S. Appl. No. 12/828,630; Titled Construction Block; filed Jul. 1, 2010; Applicant Burke A. Herron; 2 pages.
Decision Granting Petition Under 37 CFR 1 313(c)(2); Date mailed Dec. 27, 2010, U.S. Appl. No. 12/828,630, Applicant Burke A. Herron, filed Jul. 1, 2010, Titled Construction Block; 1 page.
Preliminary Amendment for U.S. Appl. No. 12/828,630, Titled: "Construction Block", Inventor: Burke A. Herron. Filed with U.S. Appl. NO. 12/828,630 on Jul. 1, 2010, 11 pages. U.S. Appl. 12/828,630 is a divisional application of U.S. Appl. No. 11/945,820, issued as U.S. Patent No. 7,765,744 on Aug. 3, 2010, which was disclosed in an Information Disclosure Statement filed on Sep. 24, 2010 for the captioned application.
Notice of Allowance, Notification Date of Jan. 14, 2011, U.S. Appl. No. 12/828,630, Titled: Construction Block, filed Jul. 1, 2010, Inventor: Burke A. Herron, 4 pages.
Supplemental Notice of Allowability, Notification Date of Mar. 3, 2011, U.S. Appl. No. 12/828,630. Titled Construction Block, filed Jul. 2010, Inventor: Burke A. Herron, 4 pages.
International Search Report and Written Opinion of the International Searching Authority, International Application No. PCT/US/2009/051266, mailed on Sep. 23, 2009.
Official Action and From PTO-892, Notification date of Oct. 5, 2009, U.S. Appl. No. 11/945,820, Titled: Construction Block, filed Nov. 27, 2007, Inventor: Burke A. Herron, 22 pages.
First Office Action, dated Dec. 1, 2010, issued by the State Intellectual Property Office of China for Chinese Patent Application No. 200780051423.4, (with English Translation), 12 pages.
Notice of Defects in Patent Application No. 199308; dated Jan. 18, 2012; issued by the Israel Patent Office for Israel Patent Application No. 199308 (with English translation); 7 pages.
Office Action; dated Feb. 28, 2012; issued by the State Intellectual Property Office of the People's Republic of China for Chinese Patent Application No. 200980128686.X (with partial English translation); 22 pages.

* cited by examiner

CONSTRUCTION BLOCK

CROSS REFERENCES

This application claims the priority benefit of U.S. Provisional Patent Application Ser. No. 61/082,393, "Construction Block", filed Jul. 21, 2008, which is expressly incorporated by reference herein in its entirety.

TECHNICAL FIELD

This application is related to construction blocks and to structures constructed from components of construction blocks.

BACKGROUND

Global terrorism, which has been steadily and significantly increasing, has created an urgent need for more effective and rapidly deployable means of protecting military and civilian personnel and a wide variety of government, commercial and private sector structures or other assets. This is particularly true in war zones where serious injury or death of military and civilian personnel can result from weapons that can include, but are not limited to: improvised explosive devices (IEDs); mortar/rocket propelled grenades (RPGs); small arms fire; and shrapnel from blasts against various structures such as concrete walls. Examples of military applications for such effective and rapidly deployable protection can include: base camps; soldier fighting positions; command posts; check point security; perimeter security and revetments around military assets, for example, aircraft; as well as temporary structural repairs. Examples of government and private sector applications of effective and rapidly deployable protection, in view of potential terrorist attacks or natural disasters such as hurricanes, can include government or commercial buildings, flood mitigation, disaster relief walls and shelters, and historic landmarks.

Known means of protection against hostile forces in war zones, as well as terrorist attacks and natural disasters include walls or revetments constructed of sandbags. Although effective in some instances, construction of such walls or revetments can be very labor intensive and they can become unstable over time. Also, in most cases the walls or revetments are not suitable for supporting additional structures. Further, the choice of ballast material that can be used is somewhat limited and the walls or revetments can be time consuming to disassemble.

Other conventional devices used to provide protection against various similar threats include walls constructed of baskets that are made from galvanized steel wire mesh. The interior of the grid-like baskets can be lined with water permeable, geotextile felt material to retain relatively smaller ballast material such as gravel, sand and fines. Such baskets are typically relatively large and often require the use of heavy earth moving equipment and a skilled labor force at the site.

SUMMARY

According to one embodiment, a construction block includes a pair of base members, each of the base members defining a first upper channel and a second upper channel. Each of the base members includes a first plurality of ribs positioned within the panels of each of the side wall assemblies includes a thermoplastic material. Each of the side wall assemblies defines a hollow load chamber having an open top and an open bottom. A first one of the side wall assemblies is releasably engaged with at least some of the first plurality of ribs of a lower one of the base members. A second one of the side wall assemblies is releasably engaged with at least some of the second plurality of ribs of the lower one of the base members. Each of the first one of the side wall assemblies and the second one of the side wall assemblies is releasably engaged with an upper one of the base members.

According to another embodiment, a construction block includes a pair of base members and a pair of side wall assemblies. Each of the base members defines a first upper channel, a second upper channel, a first lower channel and a second lower channel. Each of the base members includes a first plurality of ribs positioned within the first upper channel, a second plurality of ribs positioned within the second upper channel, a third plurality of ribs positioned within the first lower channel and a fourth plurality of ribs positioned with the second lower channel. The pair of side wall assemblies are connected to one another and each of the side wall assemblies includes a plurality of interconnected panels. For each of the side wall assemblies, each of the panels includes a thermoplastic material and is hingedly connected to each adjacent one of the panels of a respective one of the side wall assemblies. Each of the side wall assemblies defines a hollow load chamber having an open top and an open bottom. At least some of the panels of each of the side wall assemblies are angled relative to one another. Each of the panels of each of the side wall assemblies includes a lower end flange and an upper end flange. The lower end flange of each of the panels of a first one of the side wall assemblies is positioned at least partially within the first upper channel of a lower one of the base members and is releasably engaged with at least one of the first plurality of ribs of the lower one of the base members. The lower end flange of each of the panels of a second one of the side wall assemblies is positioned at least partially within the second upper channel of the lower one of the base members and is releasably engaged with at least one of the second plurality of ribs in the lower one of the base members. The upper end flange of each of the panels of the first one of the side wall assemblies is positioned at least partially within the first lower channel of the upper one of the base members and releasably engages at least one of the third plurality of ribs of the upper one of the base members. The upper end flange of each of the panels of the second one of the side wall assemblies is positioned at least partially within the second lower channel of the upper one of the base members and releasably engages at least one of the fourth plurality of ribs of the upper one of the base members.

According to another embodiment, a structure is made from a kit of construction block components. The kit includes a plurality of base members and a plurality of side wall assemblies. Each of the base members defines a first upper channel, a second upper channel, a first lower channel and a second lower channel, and each of the base members includes a first plurality of ribs positioned within the first upper channel, a second plurality of ribs positioned within the second upper channel, a third plurality of ribs positioned with the first lower channel and a fourth plurality of ribs positioned within the second lower channel. Each of the side wall assemblies includes a plurality of hingedly interconnected panels. Each of the panels includes a thermoplastic material. Each of the side wall assemblies is movable between a collapsed configuration and an erected configuration, wherein each of the side wall assemblies define, in the erected configuration, a hollow load chamber having an open top and an open bottom. The structure includes a base course that includes a first plurality of the base members disposed adjacent to one another. The base course of the structure further includes a first plurality of the side wall assemblies in the erected configuration. Each of the first plurality of the erected side wall assemblies releasably engages a respective one of the first plurality of the base members and extends upwardly therefrom. At least some of the first plurality of ribs and at least some of the second plurality of ribs of each of the first plurality of the base members releasably engages a respective one of the first plurality of the erected side wall assemblies.

BRIEF DESCRIPTION OF THE DRAWINGS

Various features and advantages of the present invention will become better understood with regard to the following description, appended claims and accompanying drawings wherein:

FIG. 2 is an exploded perspective view of the construction block shown in

FIG. 1;

DETAILED DESCRIPTION

Figure 1:
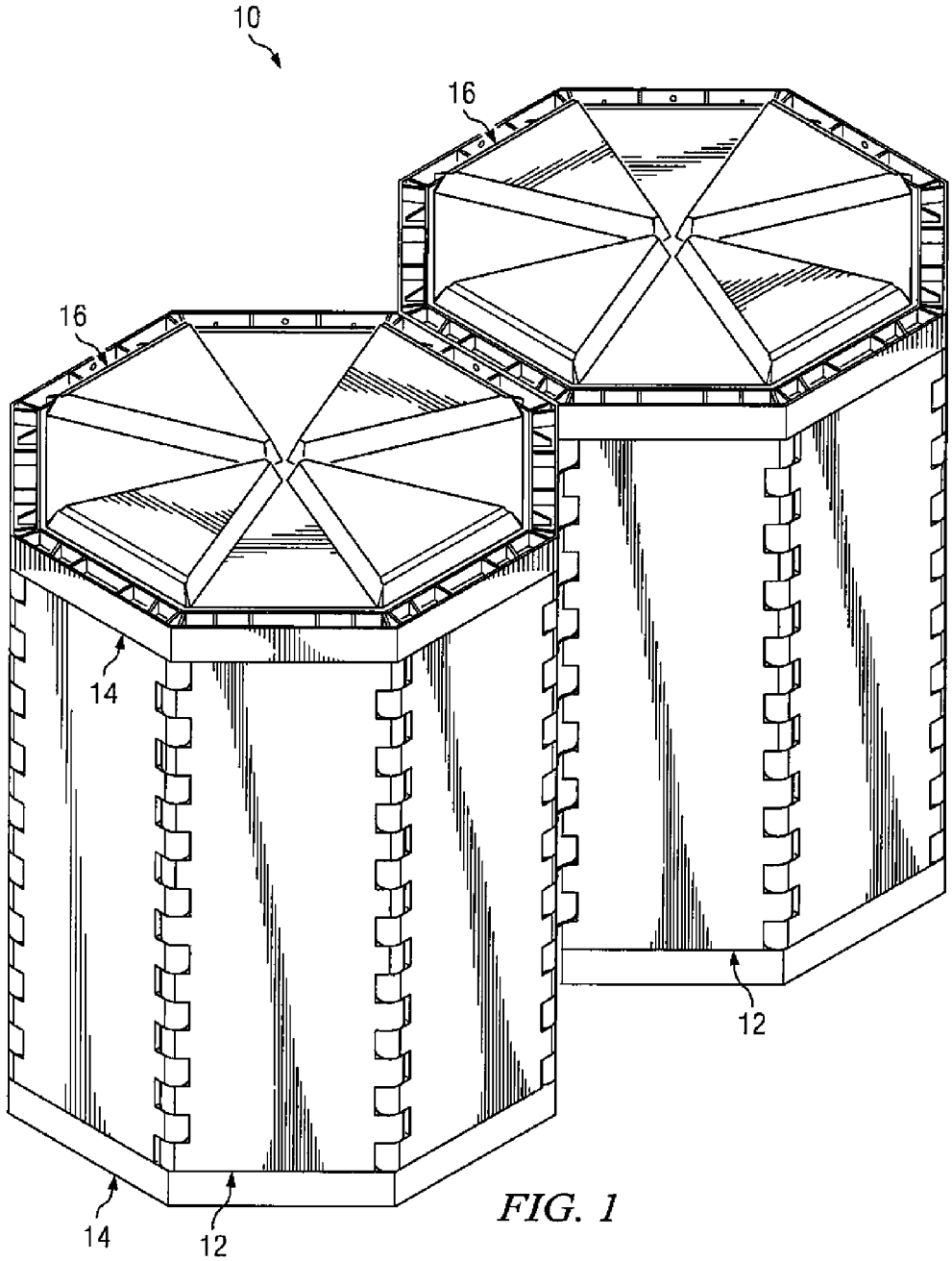
FIG. 1 is a perspective view of a construction block according to one embodiment.
Figure 2:
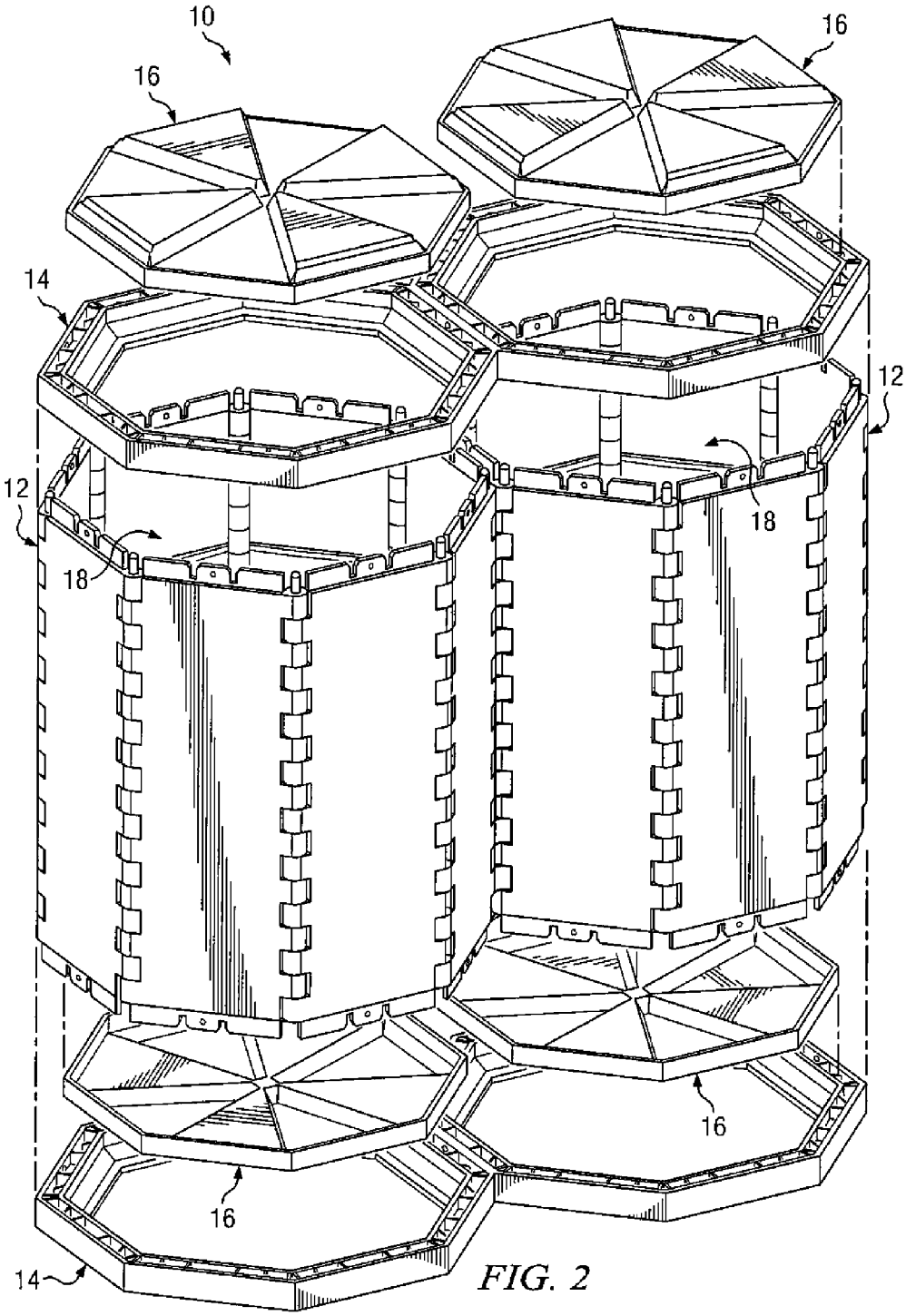
Figure 3:
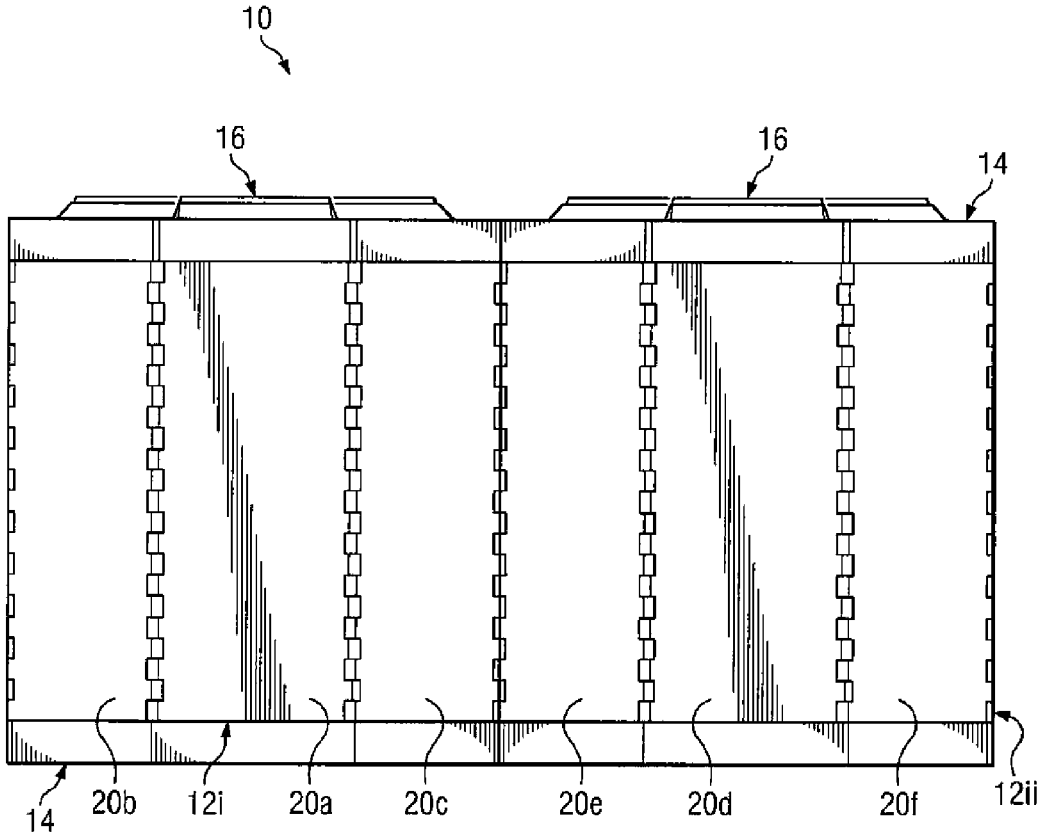
FIG. 3 is a front elevation view of the construction block shown in FIGS. 1 and 2.
Figure 4:
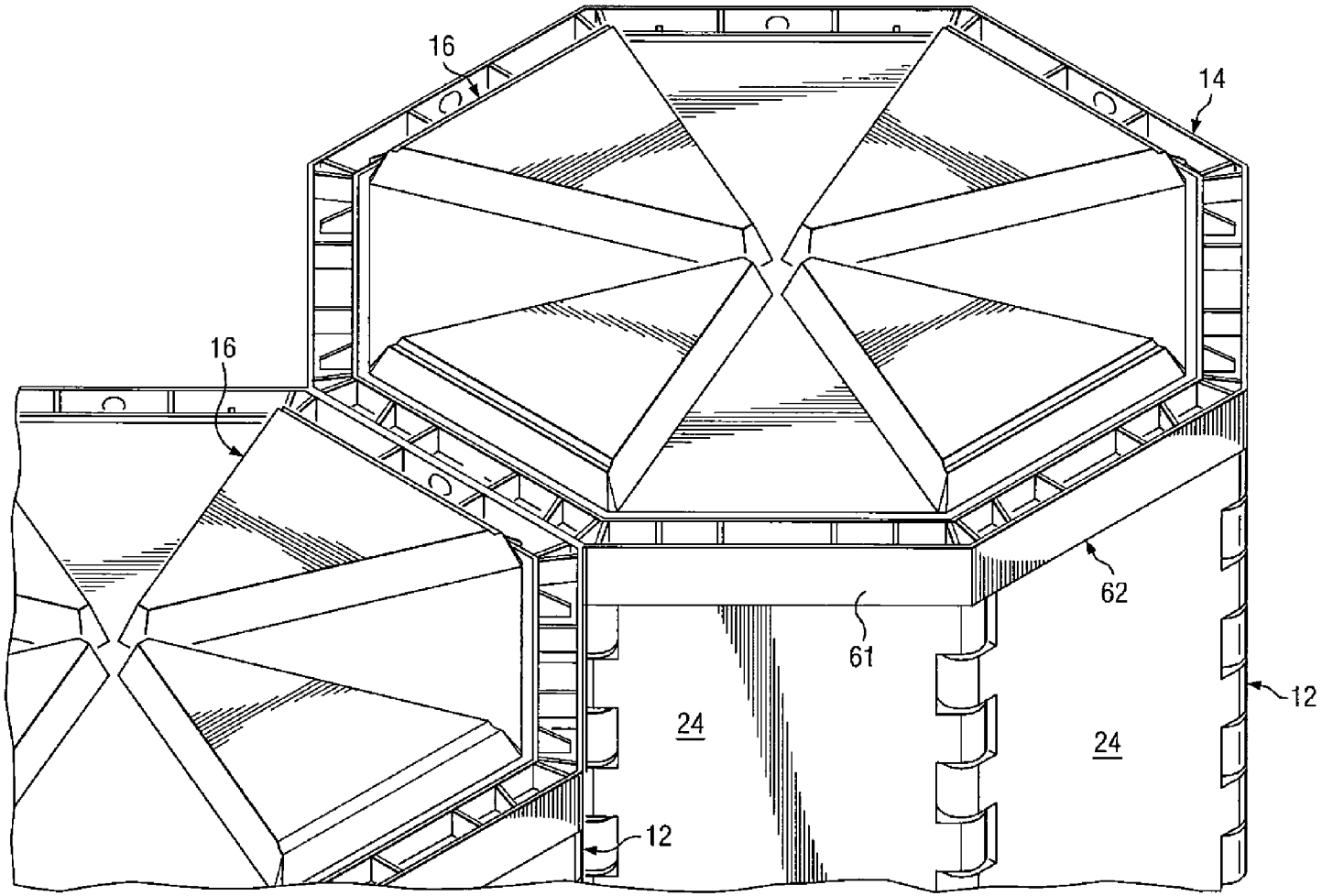
FIG. 4 is a fragmentary top perspective view illustrating a portion of the construction block shown in FIGS. 1-3.

Referring to the drawings, wherein like numbers indicate the same or corresponding elements throughout the views, FIGS. 1-4 illustrate a construction block 10 according to one embodiment. Construction block 10 can include a pair of side wall assemblies 12 that can be connected to one another. The two side wall assemblies 12 can be adjacent to one another and can be connected to one another with a plurality of links, such as links 52 shown in FIGS. 10-13. The construction block 10 can further include a pair of base members 14, with one of the base members 14 being a lower base member and engaging a lower portion of each of the side wall assemblies 12, and with the other one of the base members 14 being an upper base member and engaging an upper portion of each of the side wall assemblies 12, as shown in FIGS. 1, 3 and 4. Each of the side wall assemblies 12 can be releasably engaged with each of the lower and upper ones of the base members 14. The upper one of the base members 14 can also function as an open lid.

The construction block 10 can also include a pair of caps 16, with each of the caps 16 being disposed in an upright orientation and releasably engaged with the upper one of the base members 14 as shown in FIGS. 1, 3 and 4. Construction block 10 can also include a second pair of caps 16, with each of the second pair of caps 16 being disposed in an inverted orientation and releasably engaged with the lower one of the base members 14, such that each of the inverted caps 16 can be nested within the lower one of the base members 14 as will be appreciated with reference to FIG. 2. Each of the side wall assemblies 12 defines a hollow load chamber 18 (FIG. 2). The pair of caps 16 releasably engaged with the upper one of the base members 14 can prevent unwanted material from entering the load chambers 18, and the pair of caps 16 releasably engaged with the lower one of the base members 14 can retain ballast material (not shown in FIGS. 1-4) within the hollow load chambers 18.

The incorporation of either one or two caps 16 releasably engaged with the upper one of the base members 14, and/or the incorporation of either one or two caps 16 releasably engaged with the lower one of the base members 14, can depend upon the particular application. For example, if a single construction block 10 is used as a stand-alone structure, or if multiple construction blocks 10 are positioned adjacent one another, each of the construction blocks 10 can include caps 16 releasably engaged with the lower one and/or the upper one of the base members 14. In other applications, for example in structures having multiple courses or layers stacked on top of one another, the particular components that are incorporated in the structure can depend upon the location of the components within the structure. For example, to permit communication between the aligned hollow load chambers 18 of side wall assemblies 12 of vertically adjacent courses of the structure, caps 16 may not be used in conjunction with the base members 14 that are positioned between vertically adjacent courses of the structure.

In another embodiment, a construction block can be provided that includes a pair of side wall assemblies, such as side wall assemblies 12, and a single base member, such as a base member 14, releasably engaged with an upper portion of each of the side wall assemblies 12. The construction block according to this embodiment can include one or two caps 16, in an upright orientation, releasably engaged with the single, upper base member 14, but does not include a lower base member 14, and therefore does not include inverted caps 16 releasably engaged with a lower base member 14.

Figure 5:
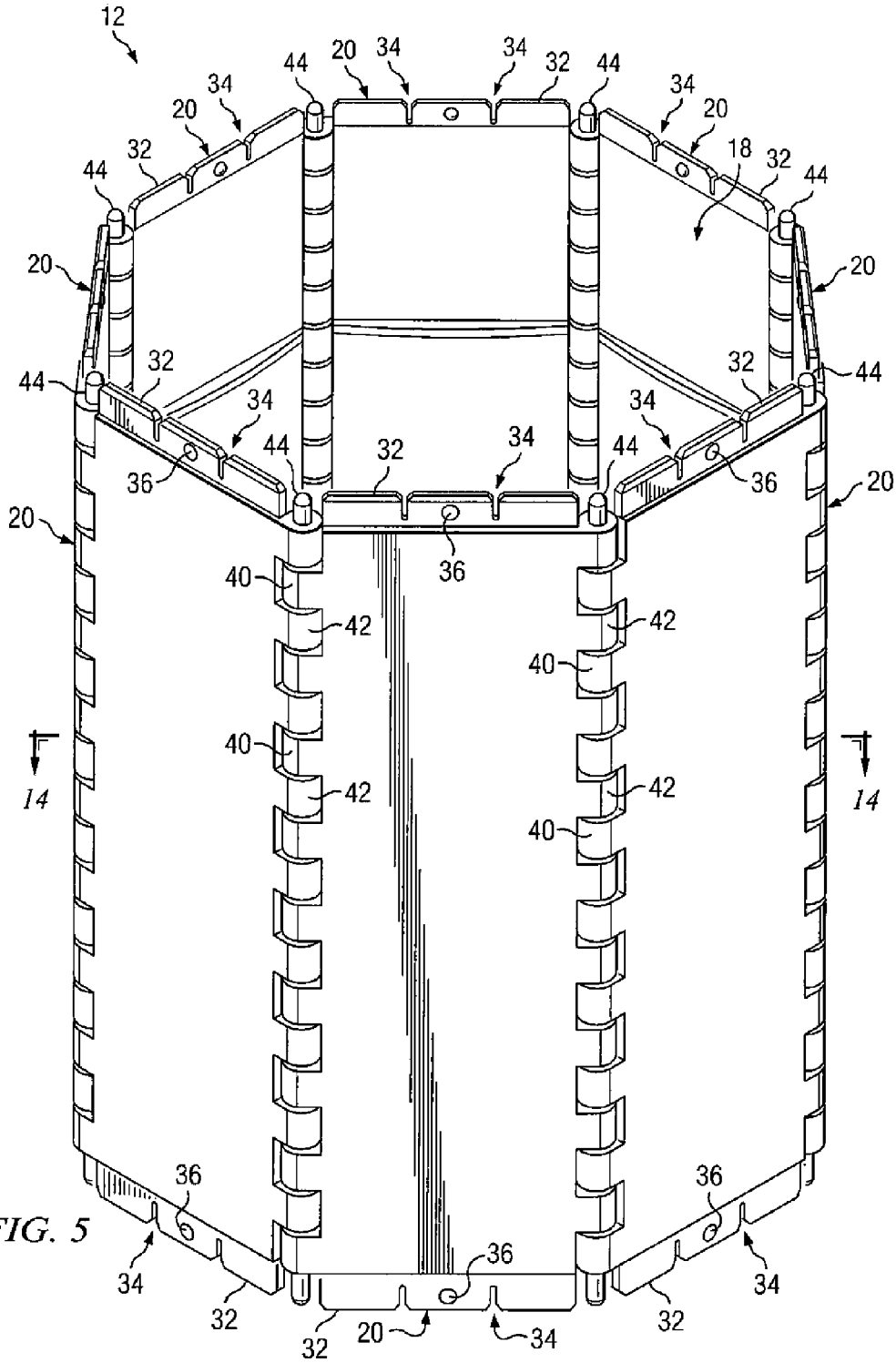
FIG. 5 is a perspective view of a collapsible side wall assembly according to one embodiment, which can be used in the construction block shown in FIGS. 1-4.
Figure 18:
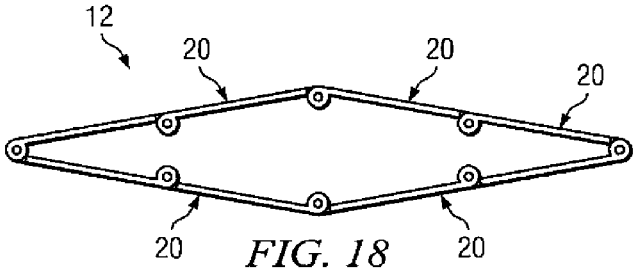
FIG. 18 is a plan view of the collapsible side wall assembly shown in FIGS. 5 and 14, with the side wall assembly shown in a partially collapsed configuration.
Figure 19:
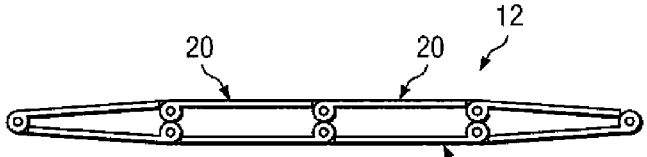
FIG. 19 is a plan view of the side wall assembly shown in FIG. 18, with the side wall assembly shown in a completely collapsed configuration.

As shown in the side wall assembly depicted in FIG. 5, each of the side wall assemblies 12 can include a plurality of interconnected panels 20, which can be hingedly interconnected, so that the plurality of interconnected panels 20, and therefore the respective side wall assembly 12, can be movable between a collapsed configuration and an erected configuration. FIG. 19 illustrates one of the side wall assemblies 12 in a collapsed configuration. FIG. 18 illustrates one of the side wall assemblies 12 in a partially collapsed configuration, and FIG. 5 illustrates one of the side wall assemblies 12 in an erected configuration. The side wall assemblies 12 are in the erected configuration when they are releasably engaged with one or more of the base members 14. Each panel 20, of each side wall assembly 12, is positioned intermediate a pair of the panels 20 and can be hingedly connected to each adjacent panel 20. For example, as shown in FIG. 3, panel 20*a* of side wall assembly 12*i* is positioned intermediate panels 20*b* and 20*c*, and can be hingedly connected to each of the panels 20*b* and 20*c*. Similarly, panel 20*d* of side wail assembly 12*ii* is positioned intermediate panels 20*e* and 20*f*, and can be hingedly connected to each of the panels 20*e* and 20*f*. The hinged connection between a pair of adjacent panels 20 may be further appreciated with reference to FIGS. 9-13.

Panels 20 can be made from a thermoplastic material, which can be an energy-absorbing thermoplastic material and panels 20 can be formed, for example by injection molding, thermoforming, extrusion, or pultrusion, as a unitary structure. For example, panels 20 can be made from a variety of polymers. In one embodiment, panels 20 can be made from a polycarbonate material. Examples of suitable polymers that can be used include, but are not limited to: acrylonitrile butadiene styrene (ABS); high impact plastics (HIPs), for example high impact polystyrene; and various ceramifying polymers, for example ceramifying polyvinyl chloride (PVC) and ceramifying ethtylene propylene diene monomer (EPDM). The butadiene component of ABS is a "rubber-like" component that can provide impact absorption, anti-fragmentation advantages and can exhibit a self-healing characteristic, which can facilitate retaining ballast material. High impact plastics can result in manufacturing cost advantages, for example when panels 20 are mass produced. The ceramifying polymers can have superior fire resistance properties. It should be understood that the advantageous properties of the exemplary thermoplastic materials are not limited to the particular properties described above.

In one embodiment, panels 20 be made from a long-strand fiber-reinforced thermoplastic polyurethane (TPU). In one embodiment, the fibers included in the TPU can be generally aligned so that they extend in a generally longitudinal direction within panel 20, i.e. in a "top-to-bottom" direction within panel 20 when the respective side wall assembly 12 is assembled and releasably engaged with a base member 14. Panels 20 can also include various performance enhancing additives mixed with the base material of panels 20. For example, an ultra violet (UV) and/or a fire resistant material can be added to a thermoplastic material or can be a coating, which can be sprayed onto the thermoplastic material used to form panels 20.

Figure 6:
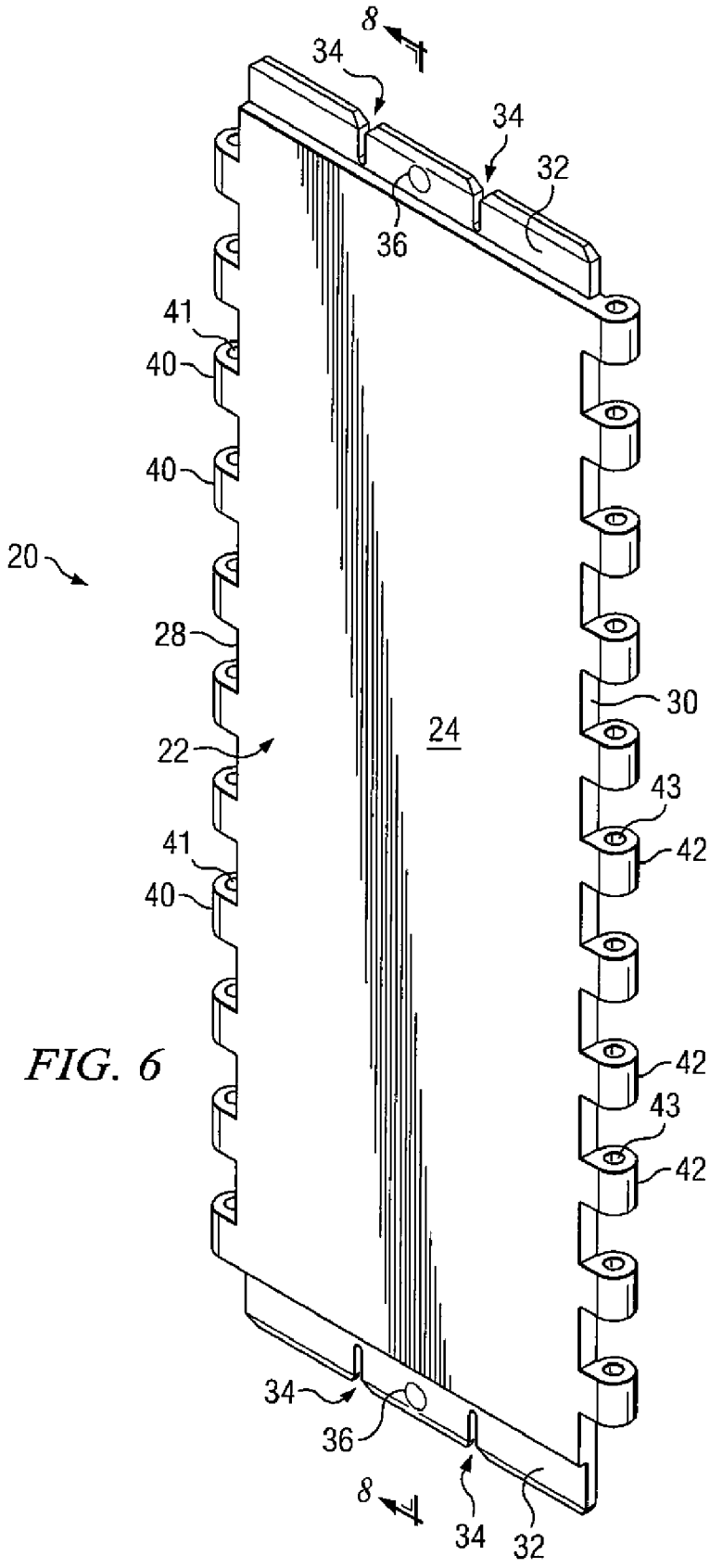
FIG. 6 is a front perspective view of one of the panels of the side wall assembly shown in FIG. 5.
Figure 7:
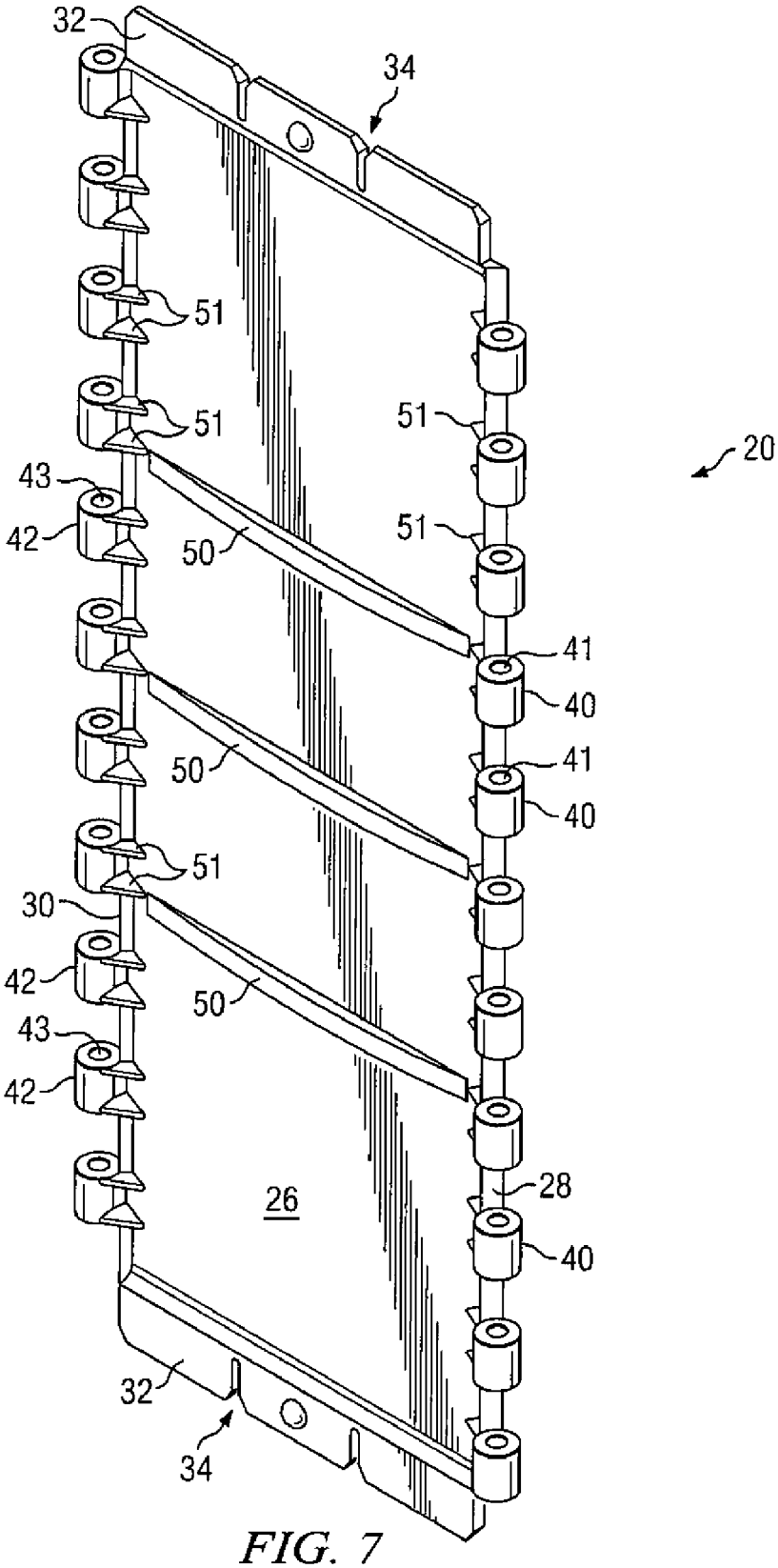
FIG. 7 is a rear perspective view of the panel shown in FIG. 6.

Each panel 20 can include a central portion 22 that can include a generally planar outer surface 24 (FIG. 6) and an inner surface 26 (FIG. 7). Each panel 20 can further include a first side 28 and a second, opposite side 30. Each panel 20 can also include a pair of end flanges 32, and each of the end flanges 32 can include one or more notches 34 formed therein as shown in FIGS. 6 and 7. As subsequently described, each of the notches 34 of each end flange 32 can engage a portion of a respective base member 14. When assembled, one of the end flanges 32 is a lower end flange and releasably engages a lower one of the base members 14, with the other end flange 32 being an upper end flange that releasably engages an upper one of the base members 14. The central portion 22 of each panel 20 can extend continuously between the first side 28 and the second side 30 of the respective one the panels 20. The central portion 22 of each panel 20 can also extend continuously between the two end flanges 32, and each panel 20 can be solid. The configuration of the pair of end flanges 32 can be the same such that each of the end flanges 32 can releasably engage either the upper one, or the lower one, of the base members 14. Each of the end flanges 32 can include a lead-in chamfer to facilitate the releasable engagement of the panels 20 of the side wall assemblies 12, with the base member 14. In other embodiments, end flanges of panels can be provided that have configurations that are different than the configuration illustrated for the end flanges 32.

Figure 8:
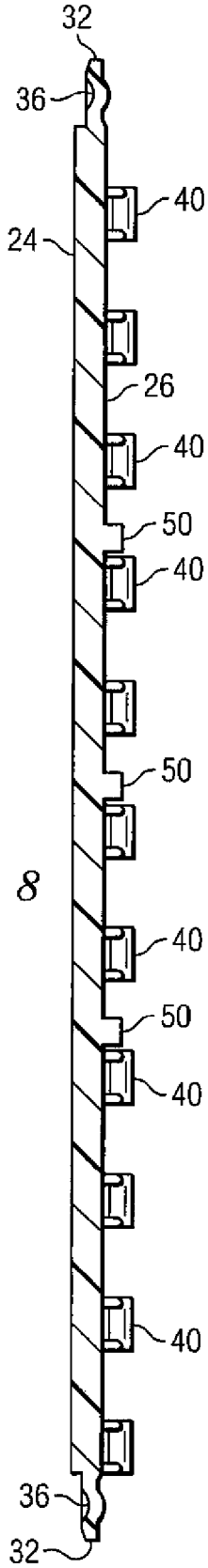
FIG. 8 is a longitudinal cross-sectional view taken along line 8-8 in FIG. 6.

With reference to FIGS. 6-8, each of the end flanges 32 can be offset inwardly from the generally planar outer surface 24 of the central portion 22 of the respective panel 20. Such inward offset allows the generally planar outer surface 24 of each panel 20 to be flush or substantially flush with an outer surface of each of the base members 14 that the respective side wall assembly 12 releasably engages. For example, each of the base members 14 can include a perimeter flange 62 that includes an outer surface 61 and, when construction block 10 is assembled, the generally planar outer surface 24 of each panel 20 can be flush or substantially flush with the outer surface 61 of the perimeter flange 62 of each of the lower one and the upper one of the base members 14.

The offset configuration of end flanges 32 of panels 20 permits the confronting panels 20 of the adjacent side wall assemblies 12 of the construction block 10 to be positioned in close proximity to one another, which can enhance the threat-protection characteristics of the construction block 10. Also, in structures constructed from components of construction block 10, the offset configuration of end flanges 32 facilitates the releasable engagement of a first one of a connected pair of the side wall assemblies 12 with a first base member 14, and the releasable engagement of a second one of the connected pair of side wall assemblies 12 with a second base member 14, which is adjacent to the first base member 14 within the same course of the structure. Each of the panels 20 can further include one or more indentations 36 formed in each of the end flanges 32, which can engage a mating protrusion of the respective base member 14 as subsequently described. In other embodiments end flanges can be provided that can include protrusions that mate with indentations in a base member.

Figure 14:
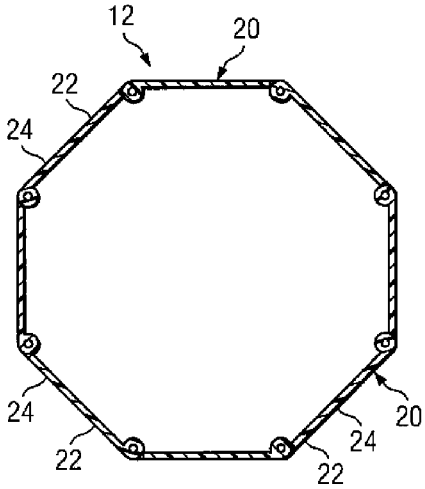
FIG. 14 is a transverse cross-sectional view taken along line 14-14 in FIG. 5.

The generally planar outer surfaces 24 of the central portions 22 of the panels 20 of each side wall assembly 12 can cooperate to define a polygon when the respective side wall assembly 12 is in an erected configuration, as shown in FIGS. 1-3 and 5, and when the respective side wall assembly 12 is viewed in a plan view (not shown) or a transverse cross-sectional view (FIG. 14). In one embodiment, the polygon can be an octagon as shown in FIG. 14. In other embodiments side wall assemblies can be provided that include panels that can define polygons having different numbers of sides and/or different arrangements.

Figure 15:
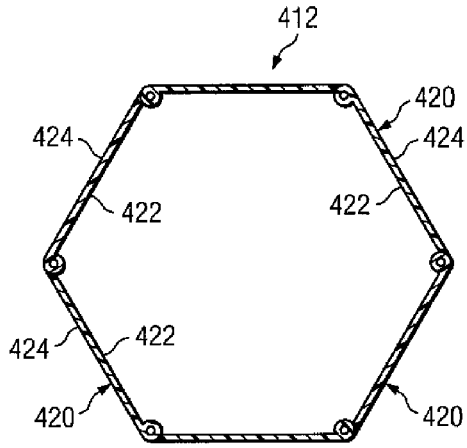
FIG. 15 is a transverse cross-sectional view similar to FIG. 14, illustrating a collapsible side wall assembly according to another embodiment.

FIG. 15 illustrates a side wall assembly 412 according to another embodiment. Assembly 412 includes six panels 420, which can have the same or different widths than panels 20 and can otherwise be the same as panels 20. As shown in FIG. 15, the generally planar outer surfaces 424 of the central portions 422 of panels 420 can cooperate to define a hexagon when side wall assembly 412 is in an erected configuration.

Figure 16:
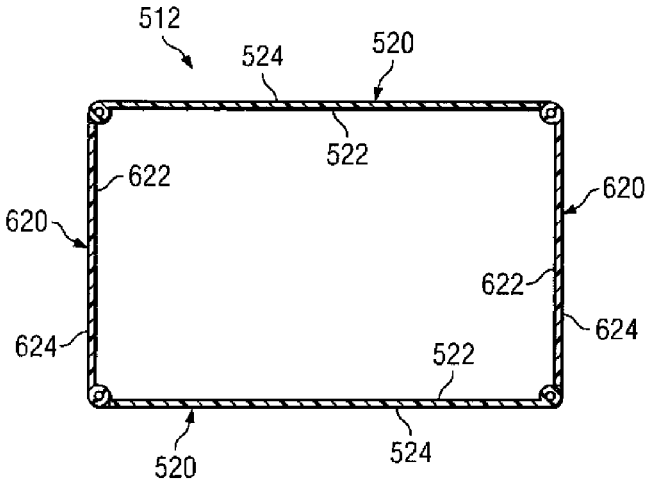
FIG. 16 is a transverse cross-sectional view similar to FIG. 14 illustrating a collapsible side wall assembly according to another embodiment.

FIG. 16 illustrates a side wall assembly 512 having two panels 520 and two panels 620. Panels 520 or panels 620 can have the same widths as panels 20, or each of the panels 520 and each of the panels 620 can have different widths than panels 20, but can otherwise be the same as panels 20. As shown in FIG. 16, the widths of panels 520 can be greater than the widths of panels 620 such that the generally planar outer surfaces 524 of the central portions 522 of panels 520 can cooperate with the generally planar outer surfaces 624 of the central portions 622 of panels 620 to define a rectangle when side wall assembly 512 is in an erected configuration.

Figure 17:
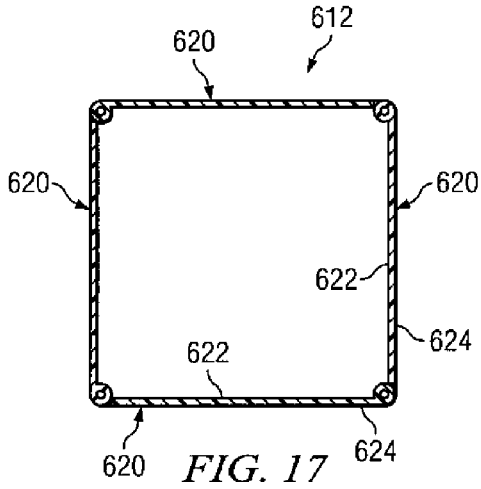
FIG. 17 is a transverse cross-sectional view similar to FIG. 14 illustrating a collapsible side wall assembly according to another embodiment.

FIG. 17 illustrates a side wall assembly 612 according to another embodiment. Assembly 612 includes four of the panels 620. As shown in FIG. 17, the generally planar outer surfaces 624 of the central portions 622 of panels 620 can cooperate to define a square when side wall assembly 612 is in an erected configuration. Side wall assemblies can be provided that have different numbers of included panels and that can define polygons having different shapes than those illustrated in FIGS. 14-17.

Figure 9:
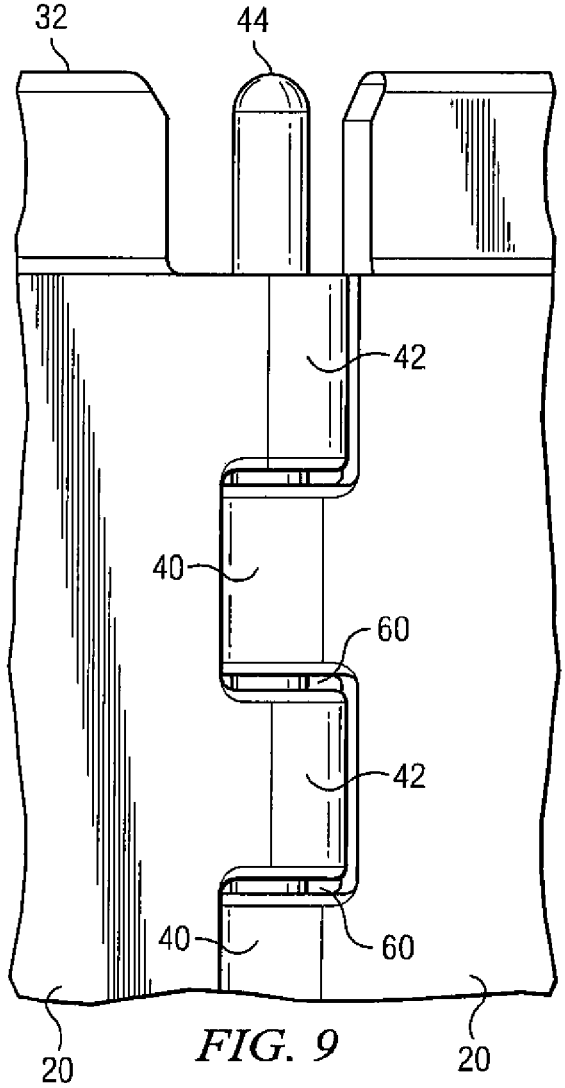
FIG. 9 is an enlarged, fragmentary perspective view illustrating portions of two adjacent panels of one of the side wall assemblies of the construction block shown in FIGS. 1-4, illustrating a portion of the hinged connection of the two panels.

Each panel 20 can include a first plurality of female hinge members 40 extending from side 28 and a second plurality of female hinge members 42 extending from side 30. The female hinge members 40 can be misaligned with the female hinge members 42 so that the female hinge members 40 of one panel 20 can be interdigitated with the female hinge members 42 of an adjacent panel 20 of each side wall assembly 12, as shown in FIGS. 5 and 9, for example. Each side wall assembly 12 can further include a plurality of male hinge members 44 as shown in FIG. 5, which can be pins, rods, bolts and the like. In one embodiment, the male hinge members 44 can be made of metal. In one embodiment, the male hinge members 44 can be made of 6061 aluminum. In other embodiments, the male hinge members 44 can be made of any of a variety of other materials including, but not limited to: various plastic materials; fiber glass; and fiber-reinforced epoxy composites.

Figure 12:
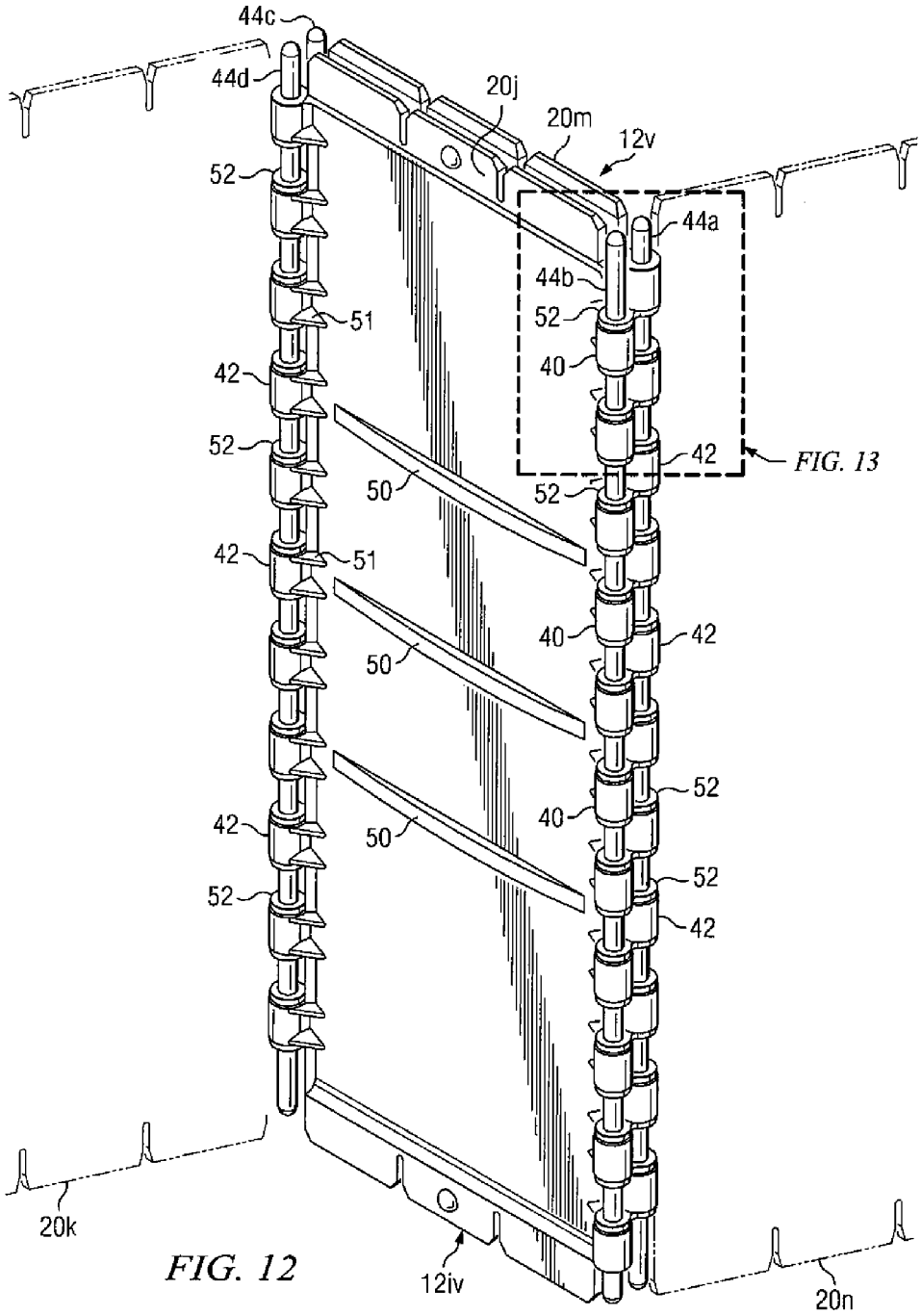
FIG. 12 is a perspective view illustrating the connection between one panel of each of the side wall assemblies of the construction block shown in FIGS. 1-4, using a plurality of the links shown in FIG. 10, and further illustrating portions of a second panel of each of the side wall assemblies in dashed lines.
Figure 13:
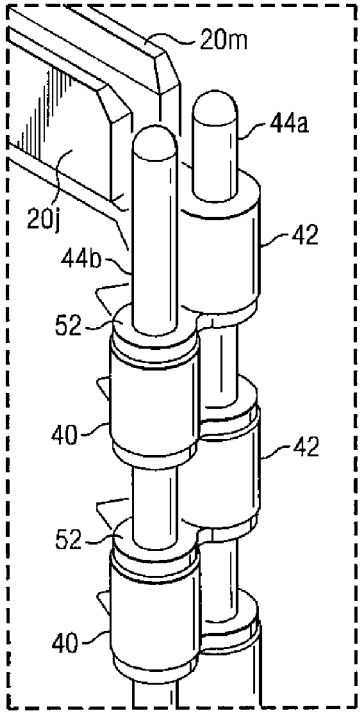
FIG. 13 is an enlarged view of the encircled area of FIG. 12, excluding the panel shown in dashed line within the encircled area.

Referring to FIGS. 6 and 7, each of the female hinge members 40 can include an aperture 41 extending therethrough and each of the female hinge members 42 can include an aperture 43 extending therethrough, with apertures 41 and 43 configured to receive one of the male hinge members 44. During assembly, each male hinge member 44 can be inserted through the apertures 41 of the female hinge members 40 of one of the panels 20 and through the apertures 43 of the aligned female hinge members 42 of an adjacent panel 20, to hingedly connect the adjacent panels 20 to one another as shown in FIG. 9 with respect to portions of two adjacent panels 20. The use of female hinge members 40 and 42, and male hinge members 44 that releasably engage the female hinge members 40 and 42, facilitates the assembly and disassembly of each side wall assembly 12. As shown in FIGS. 7 and 12, each panel 20 can include a plurality of longitudinally spaced and transversely extending ribs 50 that can extend inwardly from the inner surface 26 of panel 20 and can enhance the structural rigidity of panel 20. As further shown in FIGS. 7 and 12, each panel 20 can include a plurality of ribs 51, with each of the ribs 51 being integral with the inner surface 26 of the respective panel 20 and one of the female hinge members 40 or one of the female hinge members 42 of the panel 20 to enhance the structural rigidity of the female hinge members 40 and 42.

Figure 10:
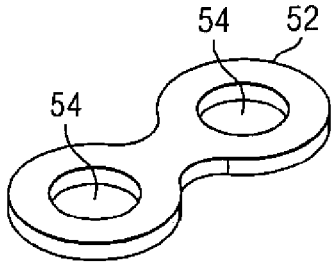
FIG. 10 is a perspective view of a link according to one embodiment that can be used to connect adjacent side wall assemblies, such as the side wall assemblies of the construction block shown in FIGS. 1-4.
Figure 11:
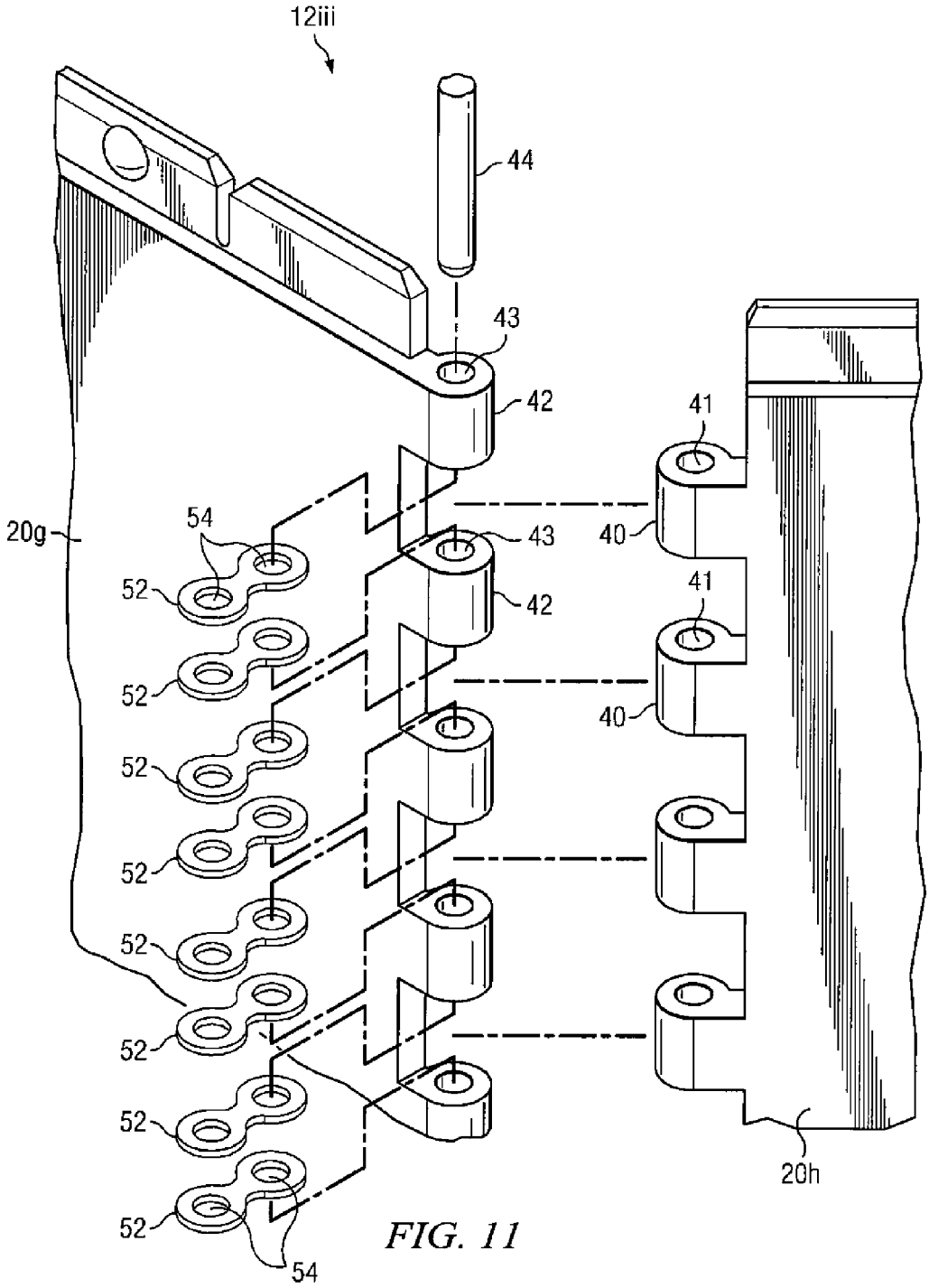
FIG. 11 is a fragmentary, exploded assembly view illustrating a portion of the hinged connection of two adjacent panels of one of the side wall assemblies of the construction block shown in FIGS. 1-4, and further illustrating the assembly of a plurality of the links shown in FIG. 10 to the two adjacent panels.

Adjacent side wall assemblies 12, such as the two side wall assemblies 12 shown in FIG. 1, can be connected with a plurality of the links 52. As shown in FIG. 10, each link 52 can include a pair of apertures 54, with each of the apertures 54 being configured and sized to receive a respective one of the male hinge members 44 of a side wall assembly 12, for example a respective one of the male hinge members 44 of one of the adjacent side wall assemblies 12 of construction block 10 shown in FIG. 1. The female hinge members 40 and 42 of panels 20 can be positioned longitudinally along the panels 20 such that, when the female hinge members 40 of one panel 20 are interdigitated and aligned with the female hinge members 42 of an adjacent panel 20 of the same side wall assembly 12, a gap 60 can be created between each interdigitated pair of female hinge members 40, 42 as shown in FIG. 9 with respect to portions of two adjacent panels 20. Gaps 60 can be sized so that each gap 60 can receive a portion of one of the links 52, i.e., a vertical height of gap 60 can be greater than a thickness of link 52. FIG. 11 illustrates the assembly of a plurality of the links 52 to two adjacent panels, identified 20*g* and 20*h*, of a side wall assembly 12*iii*. Each link 52 can be positioned so that one of the apertures 54 of each link 52 is aligned with the respective apertures 41, 43 of the interdigitated female hinge members 40, 42 of panels 20*g* and 20*h*. For example, one of the apertures 54 of each link 52 can be aligned with the apertures 43 of the female hinge members 42 of panel 20*g* and the other of the apertures 54 of each link 52 can be aligned with the apertures 41 of the female hinge members 40 of the panel 20*h*. It will be appreciated that a link 52 can be positioned between each interdigitated pair of the female hinge members 40 and 42, or between some of the interdigitated pairs of the female hinge members 40 and 42. A male hinge member 44 can then be inserted through the aligned apertures 41, 43 of the female hinge members 40, 42 and the respective apertures 54 of the links 52.

Links 52 can be used to connect two adjacent side wall assemblies 12 by positioning a first portion of each link 52 between an interdigitated pair of the female hinge members 40, 42 of two adjacent panels 20 of one side wall assembly 12 and a second portion of each link 52 between an interdigitated pair of female hinge members 40, 42 of two adjacent panels 20 of an adjacent side wall assembly 12. The use of links 52 to connect two adjacent side wall assemblies 12 can be further appreciated with reference to FIGS. 12 and 13, which illustrate portions of two adjacent side wall assemblies identified as 12*iv* and 12*v*. Panel 20*j* of side wall assembly 12*iv* is shown in solid lines in FIG. 12 and a portion of an adjacent panel 20*k* of side wall assembly 12*iv* is shown in dashed lines in FIG. 12. FIG. 12 also illustrates a portion of a panel 20*m* of side wall assembly 12*v*, in solid lines, and a portion of an adjacent panel 20*n* of side wall assembly 12*v* is shown in dashed lines. Panel 20*m* of side wall assembly 12*v* is shown to be adjacent to, and in a confronting relationship with, the panel 20*j* of side wall assembly 12*iv*.

A first portion of a first plurality of links 52 can be positioned between the female hinge members 42 of panel 20*m* of side wall assembly 12*v* and the aligned female hinge members (not shown) of the adjacent panel 20*n* of side wall assembly 12*v*. A male hinge member, designated 44*a*, can then be inserted through the apertures 43 of the female hinge members 42 of panel 20*m* and through the apertures of the aligned female hinge members of panel 20*n* to hingedly connect panels 20*m* and 20*n* of side wall assembly 12*v*. A second portion of the first plurality of the links 52 can be positioned between the female hinge members 40 of panel 20*j* of side wall assembly 12*iv* and the female hinge members (not shown) of an adjacent panel 20 (not shown) of side wall assembly 12*iv*. A male hinge member identified as 44*b* can be used to hingedly connect the panel 20*j* and an adjacent panel 20 (not shown) of side wall assembly 12*iv* and to connect panel 20*m* of side wall assembly 12*v* and panel 20*j* of side wall assembly 12*iv*, at one side of each of the panels 20*m* and 20*j*. A similar procedure can be used, with a second plurality of the links 52 and male hinge members 44*c* and 44*d* to connect panels 20*m* and 20*j* at an opposite side of each panel, and to hingedly connect panels 20*j* and 20*k* (female hinge members not shown) of side wall assembly 12*iv* and to hingedly connect panel 20*m* and an adjacent panel 20 (not shown) of side wall assembly 12*v*.

Figure 20:
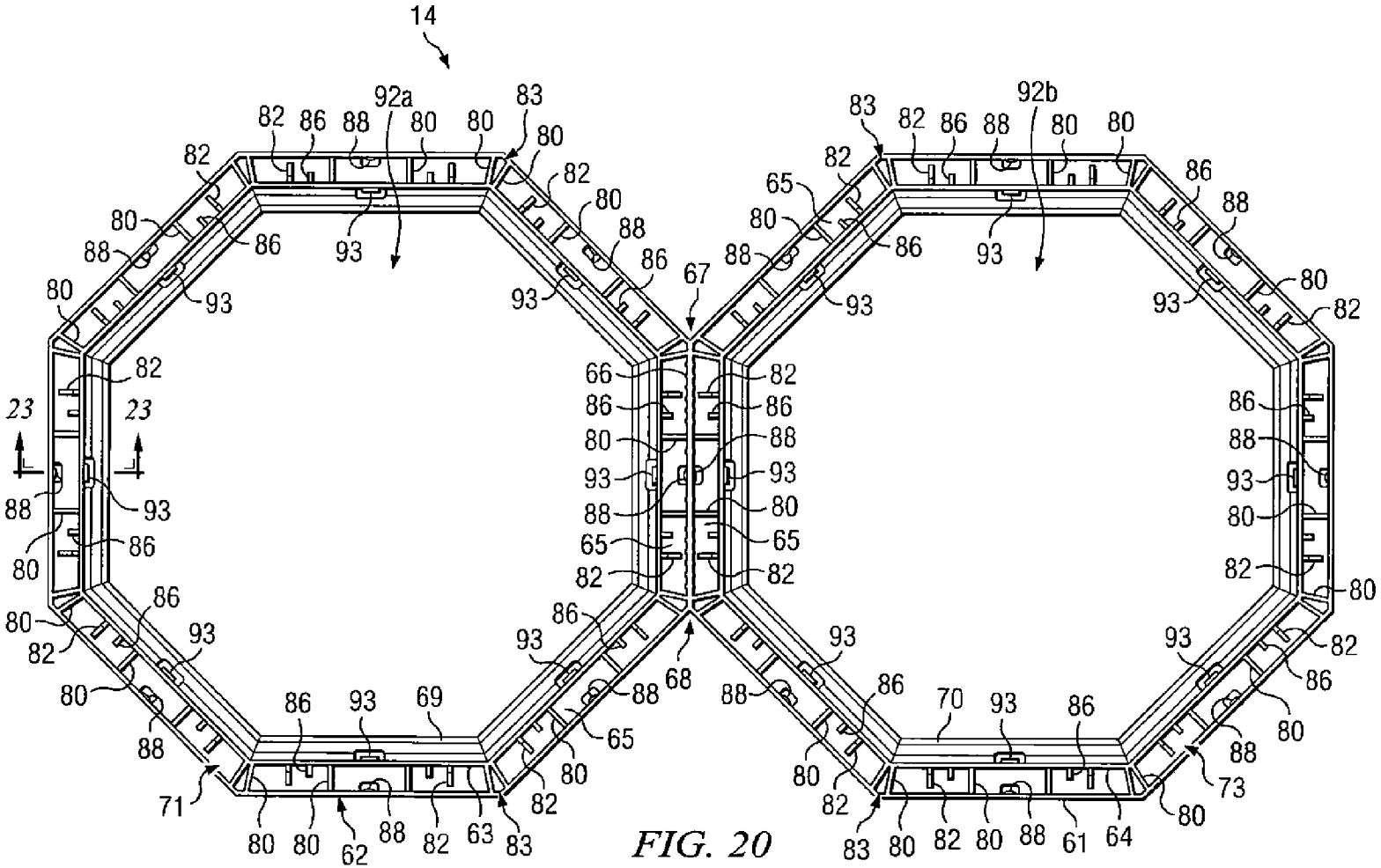
FIG. 20 is a top plan view of one of the base members of the construction block shown in FIGS. 1-4.
Figure 21:
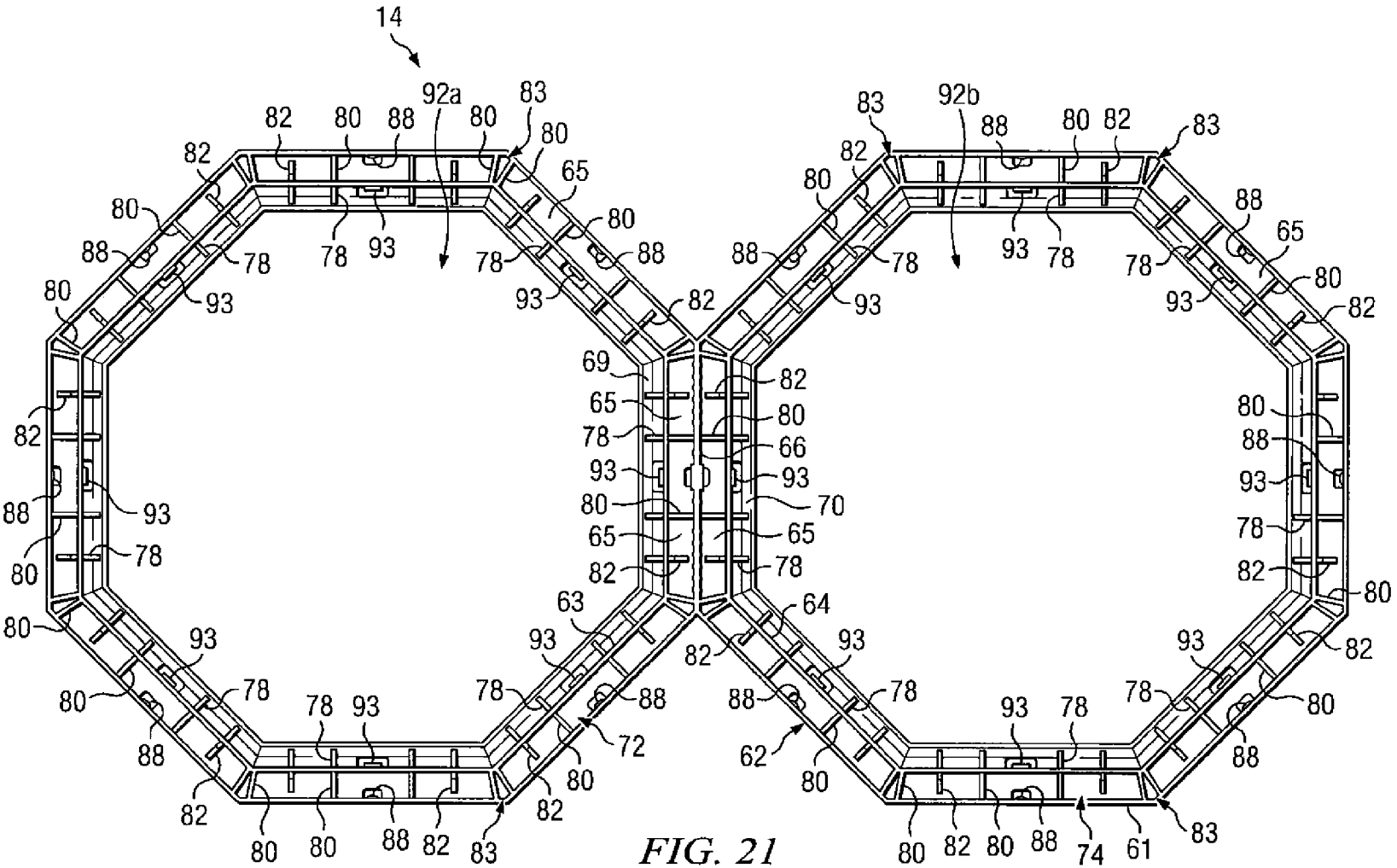
FIG. 21 is a bottom plan view of the base member shown in FIG. 20.
Figure 22:
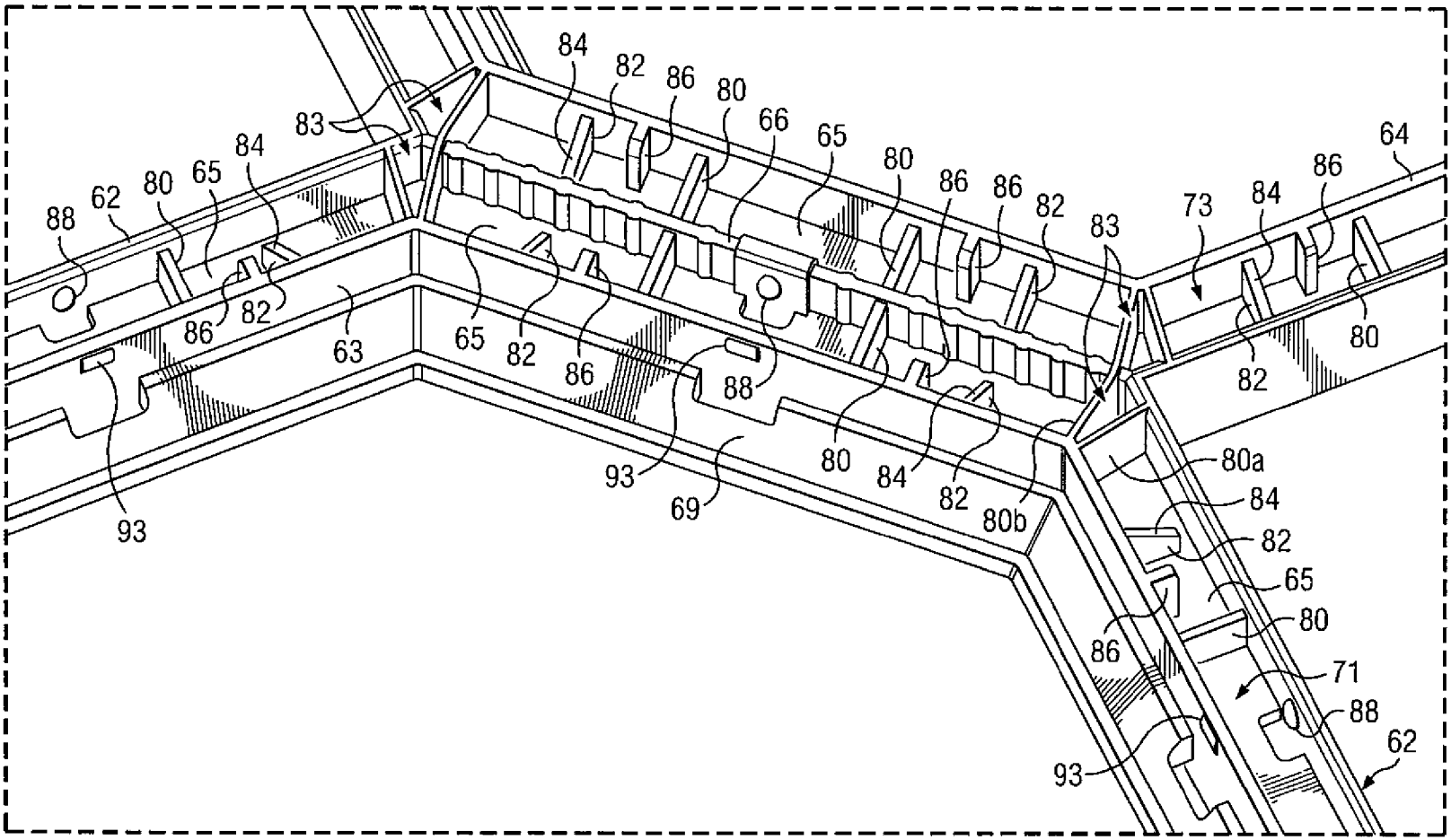
FIG. 22 is a fragmentary top perspective view of a portion of the base member shown in FIGS. 20 and 21.

Referring to FIGS. 20-22 and 24, base member 14 can further include a first inner flange 63 and a second inner flange 64, with each of the inner flanges 63, 64 being spaced inwardly from the perimeter flange 62. The base member 14 can further include a web member 65 that can be integral with the perimeter flange 62 and each of the first inner flange 63 and the second 64 inner flange. Web member 65 can be transverse to flanges 62, 63 and 64, and web member 65 can be generally planar. Base member 14 can further include a connecting flange 66, which can be integral with web member 65 and can be integral with perimeter flange 62 at two locations, indicated generally at 67 and 68 in FIG. 20. Base member 14 can also include an inner portion 69 and an inner portion 70 that are integral with, and slope away from, the inner flanges 63 and 64, respectively, as shown in FIGS. 20 and 21. Base member 14 can also include a first plurality of ribs 78 integral with a lower surface of the inner portion 69 and a second plurality of the ribs 78 integral with a lower surface of the inner portion 70. The ribs 78 can be sloped and can enhance the structural rigidity of the inner portions 69 and 70 of base member 14.

The perimeter flange 62 can cooperate with the web member 65, the first inner flange 63 and the connecting flange 66 to define a first upper channel 71 (FIG. 20) and a first lower channel 72 (FIG. 21). The perimeter flange 62 can cooperate with the web member 65, the second inner flange 64 and the connecting flange 66 to define a second upper channel 73 (FIG. 20) and a second lower channel 74 (FIG. 21).

Base member 14 can include a plurality of ribs 80 and a plurality of guides 82. A first plurality of the ribs 80 can be positioned within the first upper channel 71 and a second plurality of the ribs 80 can be positioned within the second upper channel 73. A third plurality of the ribs 80 can be positioned within the first lower channel 72 and a fourth plurality of the ribs 80 can be positioned within the second lower channel 74. Similarly, first and second pluralities of the guides 82 can be positioned within the first 71 and second 73 upper channels, respectively. Third and fourth pluralities of the guides 82 can be positioned within the first 72 and second 74 lower channels, respectively. A substantial number of the ribs 80 within any of the channels 71, 72, 73 and 74 can extend between, and be integral with, the perimeter flange 62 and the respective one of the first inner flange 63 and the second inner flange 64, as shown in FIGS. 20 and 21. Other ones of the ribs 80 positioned within the channels 71, 72, 73 and 74 can extend between, and be integral with, the connecting flange 66 and the respective one of the first inner flange 63 and the second inner flange 64.

Each of the guides 82 can be integral with either the first inner flange 63 or the second inner flange 64, and also with the web member 65, and can extend toward the perimeter flange 62 or the connecting flange 66, depending upon the location of the particular guide 82. Certain pairs of ribs 80, for example ribs 80*a* and 80*b* shown in FIG. 22, can cooperate with web member 65 to define a plurality of pockets 83, with each of the pockets 83 being configured to receive an end of a male hinge member 44 of one of the side wall assemblies 12. These pairs of the ribs 80 can define a plurality of the pockets 83 within each of the first 71 and second 73 upper channels, and within each of the first 72 and second 74 lower channels. This permits the lower end of each male hinge member 44 of each side wall assembly 12 of construction block 10 to be received within one of the pockets 83 in the respective one of the first 71 and second 73 upper channels of the lower one of the base members 14, and further permits an upper end of each of the male hinge members 44 of each of the side wall assemblies 12 of construction block 10 to be received within one of the pockets 83 in the respective one of the first 72 and the second 74 lower channels of the upper one of the base members 14. This facilities positioning the side wall assemblies 12 relative to the lower and upper ones of the base members 14 of construction block 10.

Figure 23A:
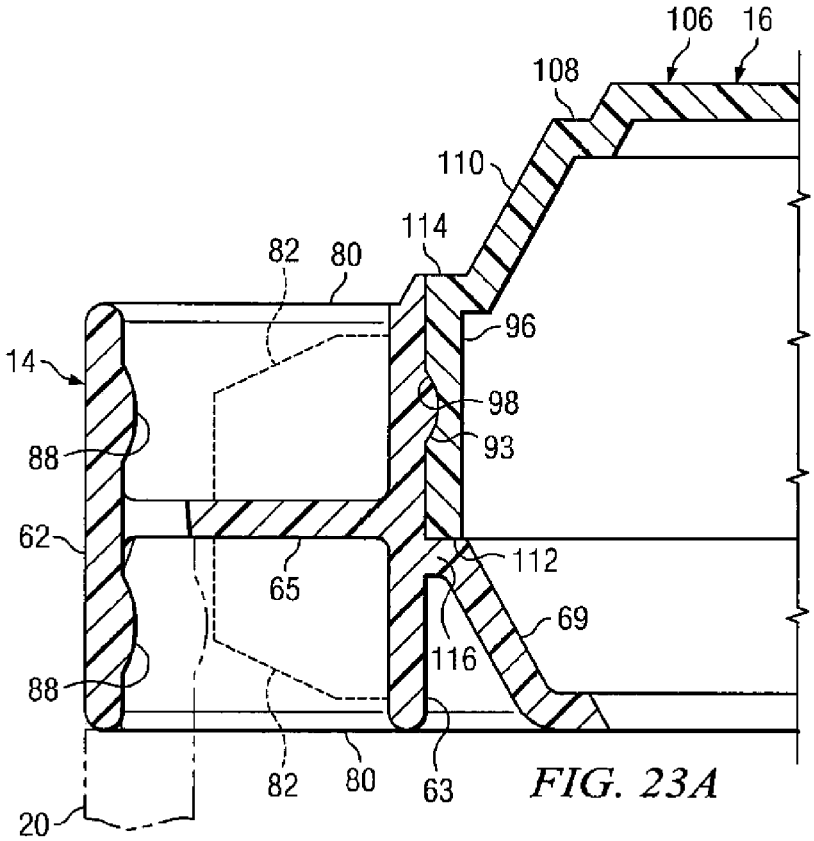
FIG. 23A is a cross-sectional view taken along line 23-23 in FIG. 20, with a portion of one of the side wall assemblies of the construction block shown in FIGS. 1-4 added and shown in dashed lines for purposes of clarity of illustration, and with a portion of one of the caps of the construction block shown in FIGS. 1-4 also being added for purposes of clarity of illustration, with the cap shown in an upright orientation.
Figure 23B:
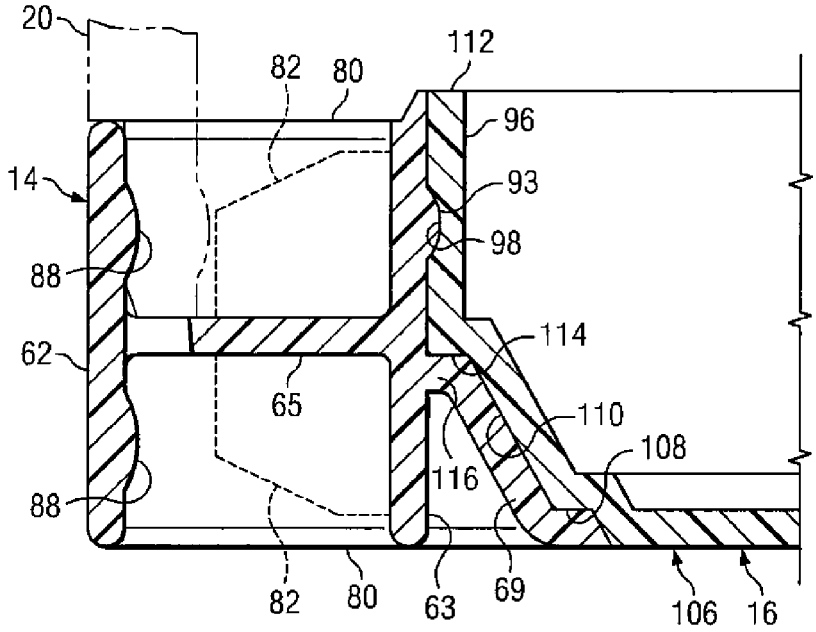
FIG. 23B is a cross-sectional view similar to FIG. 23A, but with the portion of the cap shown in an inverted orientation.
Figure 24:
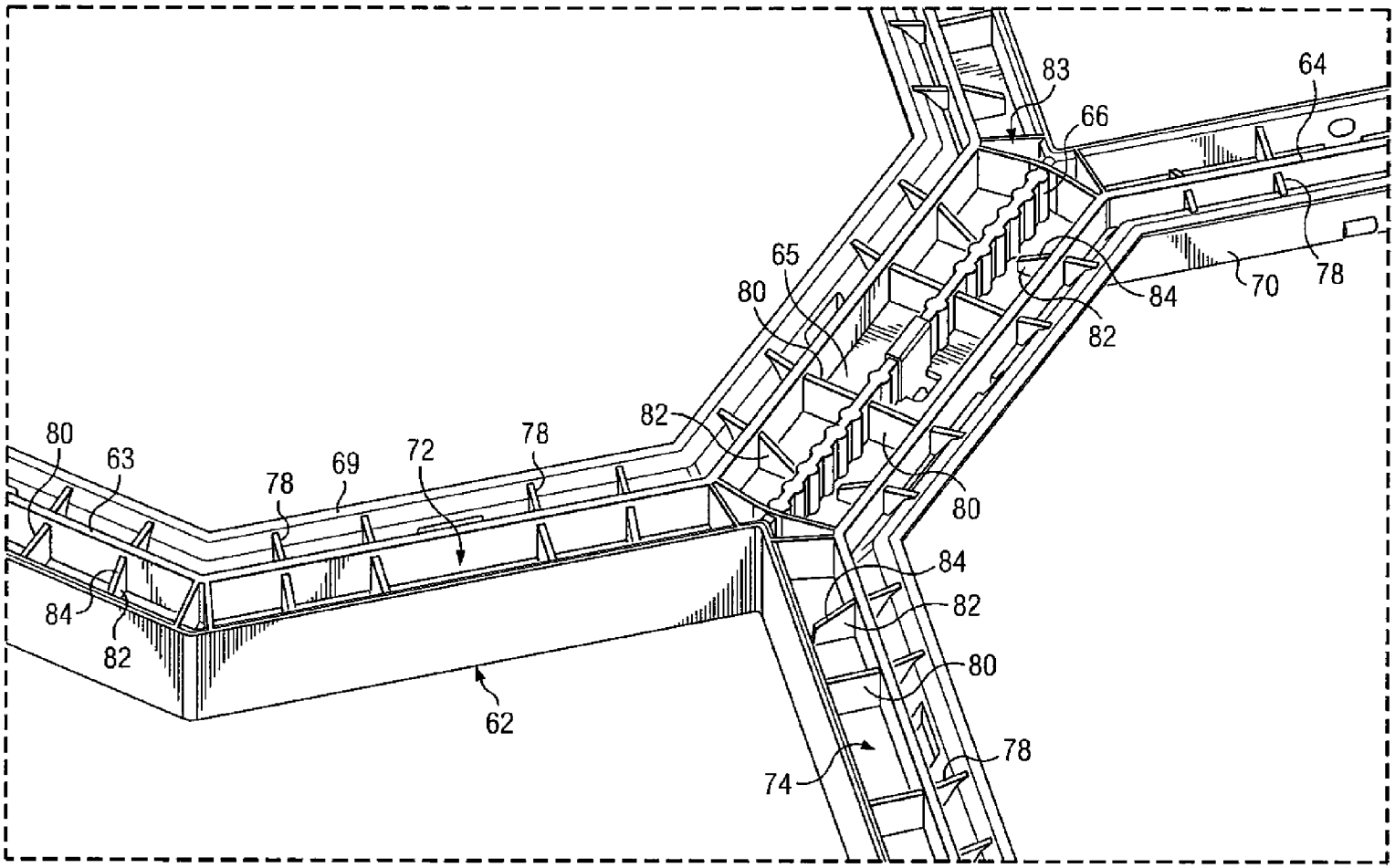
FIG. 24 is an enlarged, fragmentary bottom perspective view of a portion of the base member shown in FIGS. 20 and 21.

Each of the guides 82 can be spaced from the perimeter flange 62 or the connecting flange 66 by a distance that can be large enough to permit the end flanges 32 of each panel 20 to be positioned between the guide 80 and the respective one of the perimeter flange 62 and the connecting flange 66. In particular, as shown in FIGS. 23A and 23B, depending upon the location of the particular guide 82, the end flanges 32 of each panel 20 can be positioned within the respective one of the first upper channel 71, the first lower channel 72, the second upper channel 73 and the second lower channel 74, of the respective base member 14 releasably engaged with the panels 20.

Guides 82 can include a sloped surface 84 (FIGS. 22 and 24) that facilitates the assembly of side wall assemblies 12 to the lower and upper ones of the base members 14. With respect to guides 82 positioned within either the first upper channel 71 or the second upper channel 73, the sloped surface 84 can be an upper surface that slopes downwardly toward the perimeter flange 62 or the connecting flange 66, depending upon the location of the guide 82. With respect to guides 82 positioned within either the first lower channel 72 or the second lower channel 74, the sloped surface 84 can be a lower surface that slopes upwardly toward the perimeter flange 62 or the connecting flange 66, depending upon the location of the particular guide 82. The sloped surfaces 84 of the guides 82 can contact the end flanges 32 of panels 20 of the respective side wall assemblies 12 during the process of assembling the side wall assemblies 12 with the base members 14. In particular, during this process the end flanges 32 may ride along the sloped surface 84 of the respective guides 82 until the end flanges 32 are positioned adjacent either the perimeter flange 62 or the connecting flange 66, depending upon the location of the particular panel 20 of the respective base member 14.

Base member 14 can include a plurality of ribs 86. A first plurality of the ribs 86 can be positioned within the first upper channel 71 and can be integral with the first inner flange 63 and spaced apart from the perimeter flange 62, or the connecting flange 66 depending upon the location of the particular rib 86. A second plurality of the ribs 86 can be positioned within the second upper channel 73 and can be integral with the second inner flange 64 and spaced apart from the perimeter flange 62, or the connecting flange 66 depending upon the location of the particular rib 86. The first and second pluralities of the ribs 86 can enhance the structural integrity of the first inner flange 63 and the second inner flange 64, respectively.

The engagement of the ribs 80 of base member 14 with the notches 34 in the end flanges 32 of the panels 20 of side wall assemblies 12, facilitates positioning the side wall assemblies 12 with regard to the respective base member 14. When a particular base member 14 is utilized as a lower base member of a construction block 10 and/or is part of a bottom course of a wall or other structure such as a revetment that is constructed from components of construction blocks 10, the ribs 80 disposed within the first upper channel 71 and the second upper channel 73 can releasably engage the notches 34 formed in the lower ones of the end flanges 32 of the panels 20 of each of the side wall assemblies 12 that engage the base member 14, with panels 20 extending upwardly therefrom. In this instance, where there are no panels 20 extending below the base member 14 and therefore the ribs 80 disposed within the first lower channel 72 and the second lower channel 74 are not engaged with any panels 20. When a particular base member 14 is an upper base member 14 of a construction block 10, or is positioned between side wall assemblies 12 of vertically adjacent courses of a structure, the ribs 80 disposed within the first upper channel 71 and the second upper channel 73 can engage the notches 34 formed in the lower ones of the flanges 32 of panels 20 used in the adjacent side wall assemblies 12 that extend above the particular base member 14, while the ribs 80 disposed in the first lower channel 72 and the second lower channel 74 can engage the notches 34 formed in the upper ones of the end flanges 32 of the panels 20 included in the side wall assemblies 12 engaged with and extending below the particular base member 14.

Base member 14 can further include a plurality of protrusions 88 (FIGS. 20-22) that can have a generally hemispherical shape. Protrusions 88 can protrude from the perimeter flange 62 or the connecting flange 66. Each of the protrusions 88 can engage a respective one of the indentations 36 (FIG. 6), which can have a complementary shape, formed in the end flanges 32 of panels 20, which can also facilitate the releasable engagement and/or positioning of the panels 20 of each side wall assembly 12 relative to the respective base member 14.

The inner portion 69 of base member 14 can have the same shape and size as the inner portion 70 of base member 14. The inner portion 69 can define an aperture 92*a* and the inner portion 70 can define an aperture 92*b*, which can have the same shape and size as aperture 92*a*. Each of the inner portion 69 and the inner portion 70 can be shaped and sized to releasably engage one of the caps 16. Each of the apertures 92*a*, 92*b* can have a polygonal shape, which can be an octagonal shape as shown in FIGS. 20 and 21. Each of the apertures 92*a*, 92*b* of the upper one of the base members 14 of construction block 10 can communicate with an aligned hollow load chamber 18 of a respective one of the side wall assemblies 12. Each of the apertures 92*a*, 92*b* of the lower one of the base members 14 of construction block 10 can communicate with an aligned hollow load chamber 18 of a respective one of the side wall assemblies 12. However, in the instance when one or two of the caps 16 are disposed in an inverted orientation and releasably engaged with the lower one of the base members 14, as subsequently described with respect to the cap 16 shown in FIG. 23B, each of the caps 16 positioned over a respective one of the apertures 92*a*, 92*b* prevents communication between the respective one of the apertures 92*a*, 92*b* and the aligned hollow load chamber 18 of the respective side wall assembly 12. Further, the apertures 92*a*, 92*b* of a base member 14 positioned in a structure between the side wall assemblies 12 of vertically adjacent courses of the structure can communicate with each of the respective aligned hollow load chambers 18 of each of the vertically adjacent courses. Base member 14 can include a plurality of tabs 93 formed therein, with each of the tabs 93 protruding inwardly from a respective one of the first inner flange 63 and the second inner flange 64.

Figure 25:
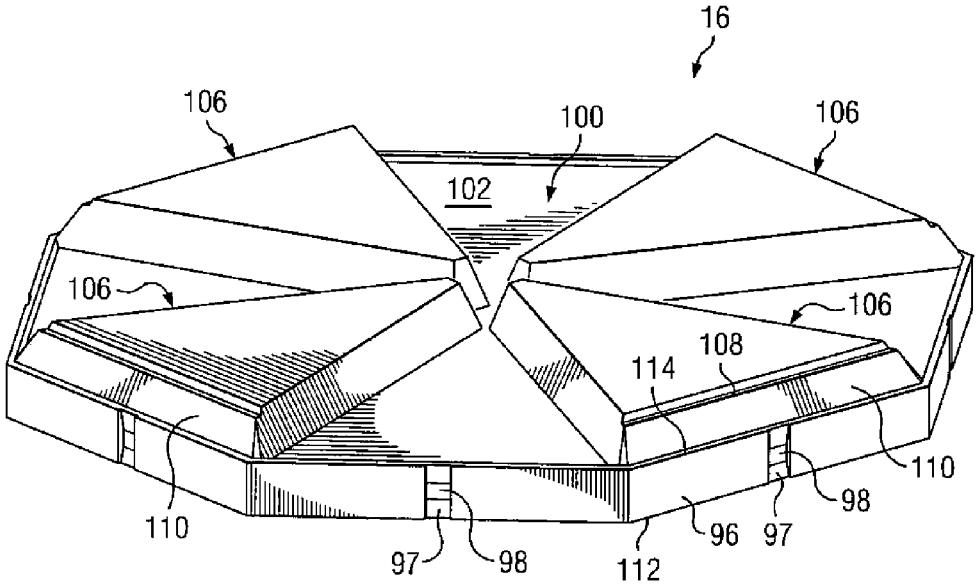
FIG. 25 is a perspective view of one of the caps of the construction block shown in FIGS. 1-4, with the cap shown in an upright orientation.
Figure 26:
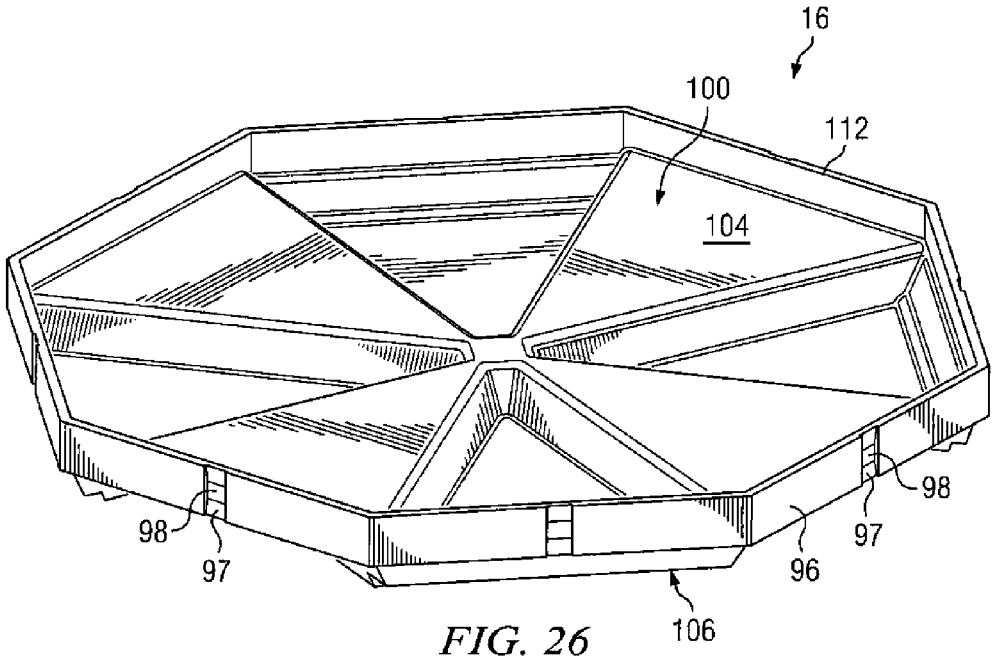
FIG. 26 is a perspective view of the cap shown in FIG. 25, with the cap shown in an inverted orientation.

As shown in FIGS. 25 and 26, each of the caps 16 can include a perimeter flange 96 that can be releasably engaged with base member 14. The perimeter flange 96 can have a shape that is complementary to the transverse cross-sectional shape of one of the side wall assemblies 12, and to each of the first inner flange 63 and the second inner flange 64 of base member 14. For example, the perimeter flange 96 can have a polygonal shape, which can be an octagonal shape as shown in FIGS. 25 and 26. The perimeter flange 96 of cap 16 can define a plurality of slots 97 and a plurality of indentations 98, with each indentation 98 positioned within a respective one of the slots 97. As described in further detail below, the tabs 93 of base member 14 can selectively interact with the indentations 98 to facilitate the releasable engagement of cap 16 with a respective one of the flanges 63, 64 of base member 14.

Cap 16 can include a central portion 100 that can be integral with the perimeter flange 96. The central portion 100 can include an upper surface 102 (FIG. 25), a lower surface 104 (FIG. 26), and a plurality of circumferentially spaced protrusions 106 that can extend above the upper surface 102. Each of the upper surface 102 and the lower surface 104 can be planar, and each of the protrusions 106 can be generally wedge-shaped. The protrusions 106 can enhance the structural rigidity of cap 16. Each of the protrusions 106 can include a shoulder 108 and a plurality of side surfaces. At least one of the side surfaces, designated 110, of each of the protrusions 106 can be sloped at an angle that is the same or substantially the same as a downward sloping portion of each of the inner portions 69, 70 of base member 14. This configuration of the side surfaces 110 of protrusions 106 facilitates the engagement of the sloped surface 110 of each of the protrusions 106, with a respective one of the inner portions 69 and 70 of the lower one of the base members 14, with the cap 16 inverted as subsequently described in further detail with reference to FIG. 23B. The perimeter flange 96 can include a lower edge 112 and an upper edge 114.

Figure 27:
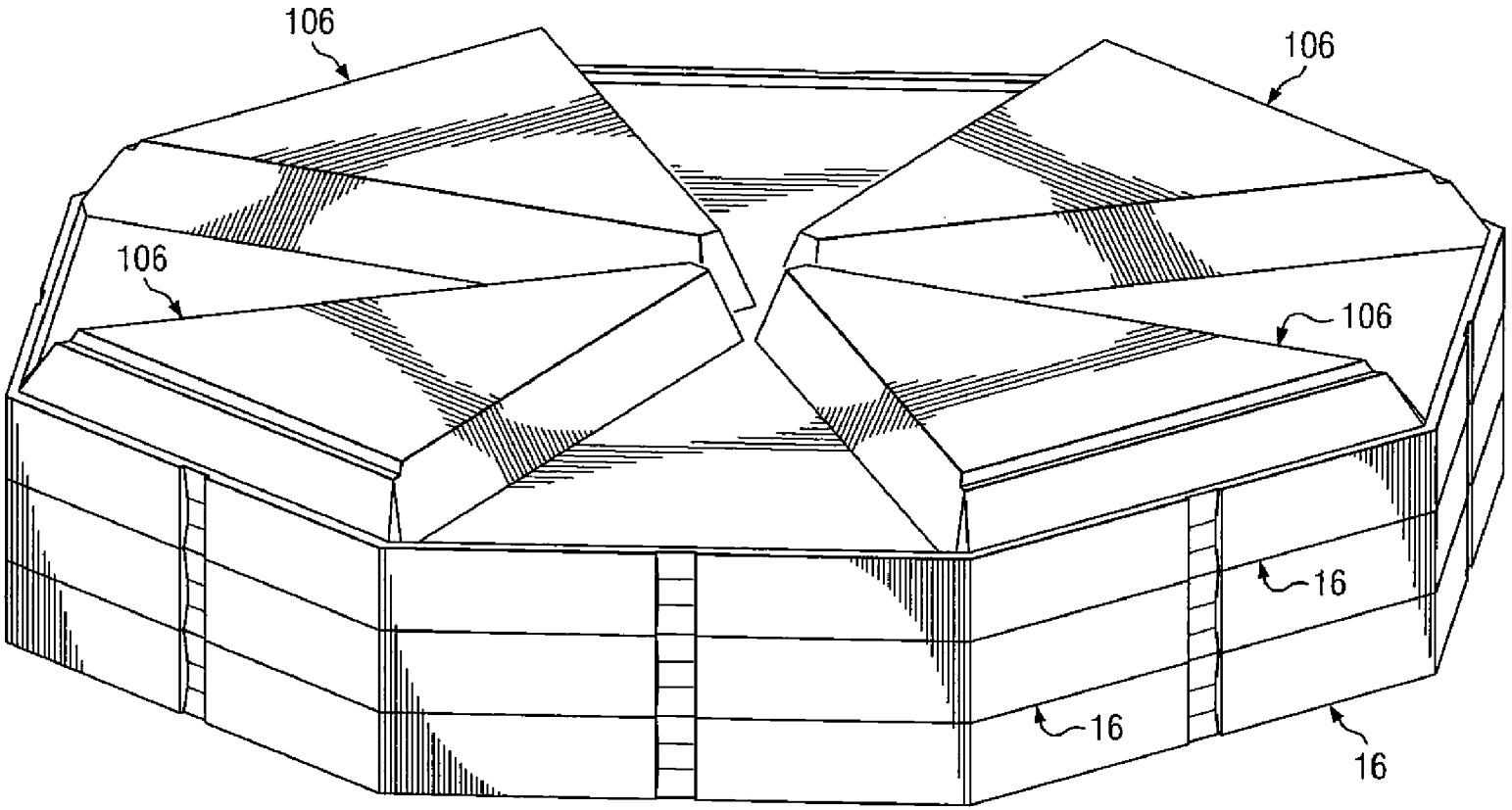
FIG. 27 is a perspective view of the three of the caps shown in FIGS. 25 and 26, with the caps shown in an upright orientation and stacked on top of one another.

The releasable engagement of one of the caps 16 with one of the base members 14, with the cap 16 in an upright orientation, and with the base member 14 being the upper one of the base members 14 of construction block 10, is shown in FIG. 23A with respect to the first inner flange 63 and the first inner portion 69 of the base member 14. In this configuration, the lower edge 112 of the perimeter flange 96 of cap 16 can rest on top of a shoulder 116 of the inner flange 63 that is integral with the inner portion 69 of base member 14. One of the indentations 98 defined by the perimeter flange 96 can releasably engage a mating one of the tabs 93 protruding from the inner flange 63 of base member 14. One of the caps 16, in an upright orientation, can releasably engage the second inner flange 64 and the tabs 93 protruding from the second inner flange 64 of the upper one of the base members 14 in a similar manner. FIG. 27 illustrates three of the caps 16, in an upright orientation, stacked on top of one another.

The releasable engagement of one of the caps 16 with one of the base members 14, with the cap 16 in an inverted orientation and with the base member 14 being the lower one of the base members 14 of construction block 10, is shown in FIG. 23B, with respect to the first inner flange 63 and the first inner portion 69 of the base member 14. In this configuration, the upper edge 114 of the perimeter flange 96 of cap 16 rests on top of the shoulder 116, and the sloped surface 110 of each of the protrusions 106 (one shown) can engage the inner portion 69 of base member 14. Also, one of the indentations 98 defined by the perimeter flange 96 of cap 16 can engage a mating tab 93 of base member 14 and the shoulder 108 of cap 16 can engage a lower, generally horizontal portion of the inner portion of 69 of base member 14 as shown in FIG. 23B. One of the caps 16, in an inverted orientation, can releasably engage the second inner flange 64 and second inner portion 70 of the lower one of the base members 14 in a similar manner. FIGS. 23A and 23B each illustrate a portion of a panel 20, releasably engaged with a protrusion 88 protruding from the perimeter flange 62 of the respective base member 14.

Figure 28:
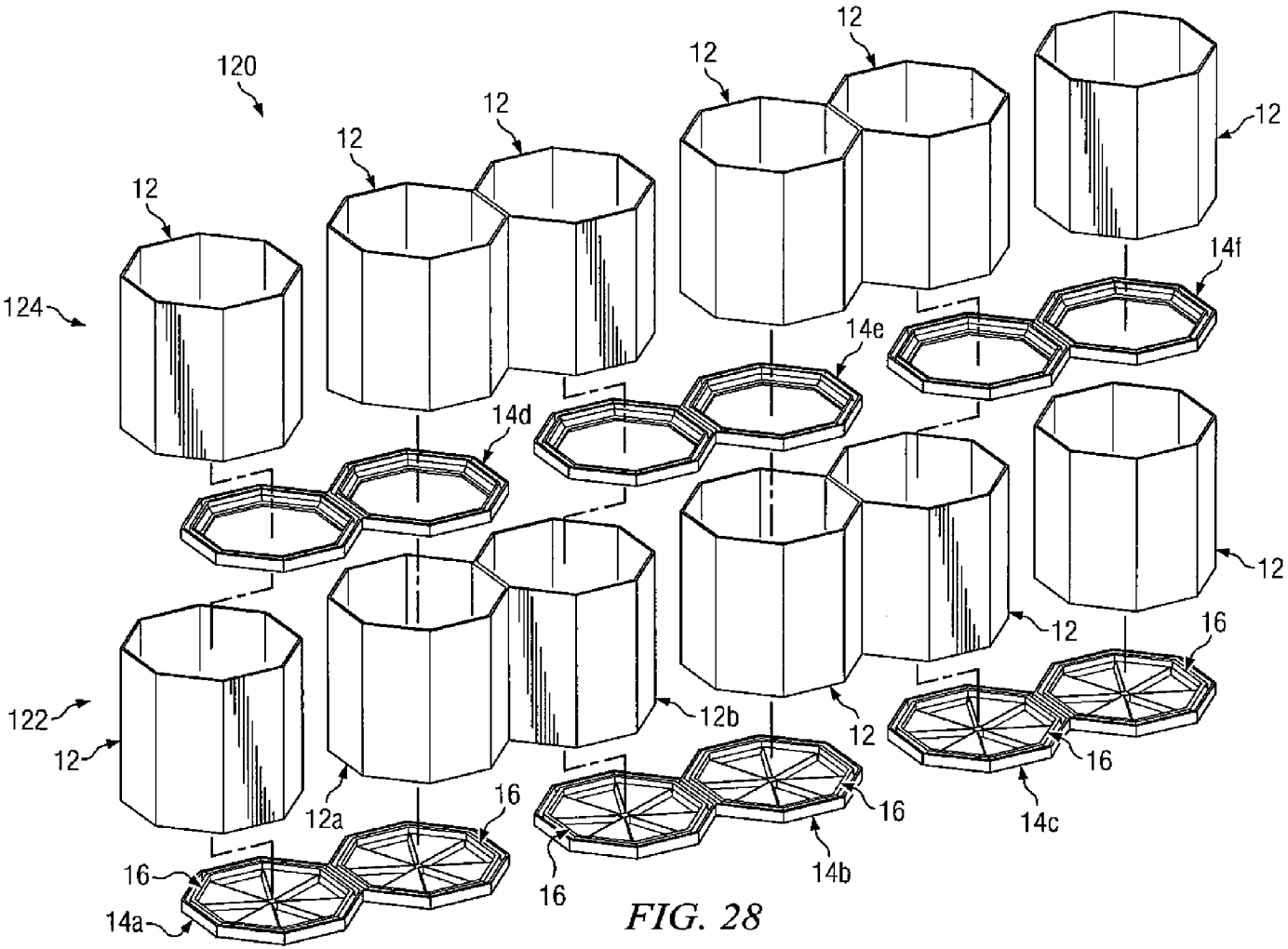
FIG. 28 is an exploded assembly view, shown in perspective, of a structure according to one embodiment, that can be constructed from components of the construction block shown in FIGS. 1-4, with certain elements of the construction block components omitted for ease of illustration.
Figure 29:
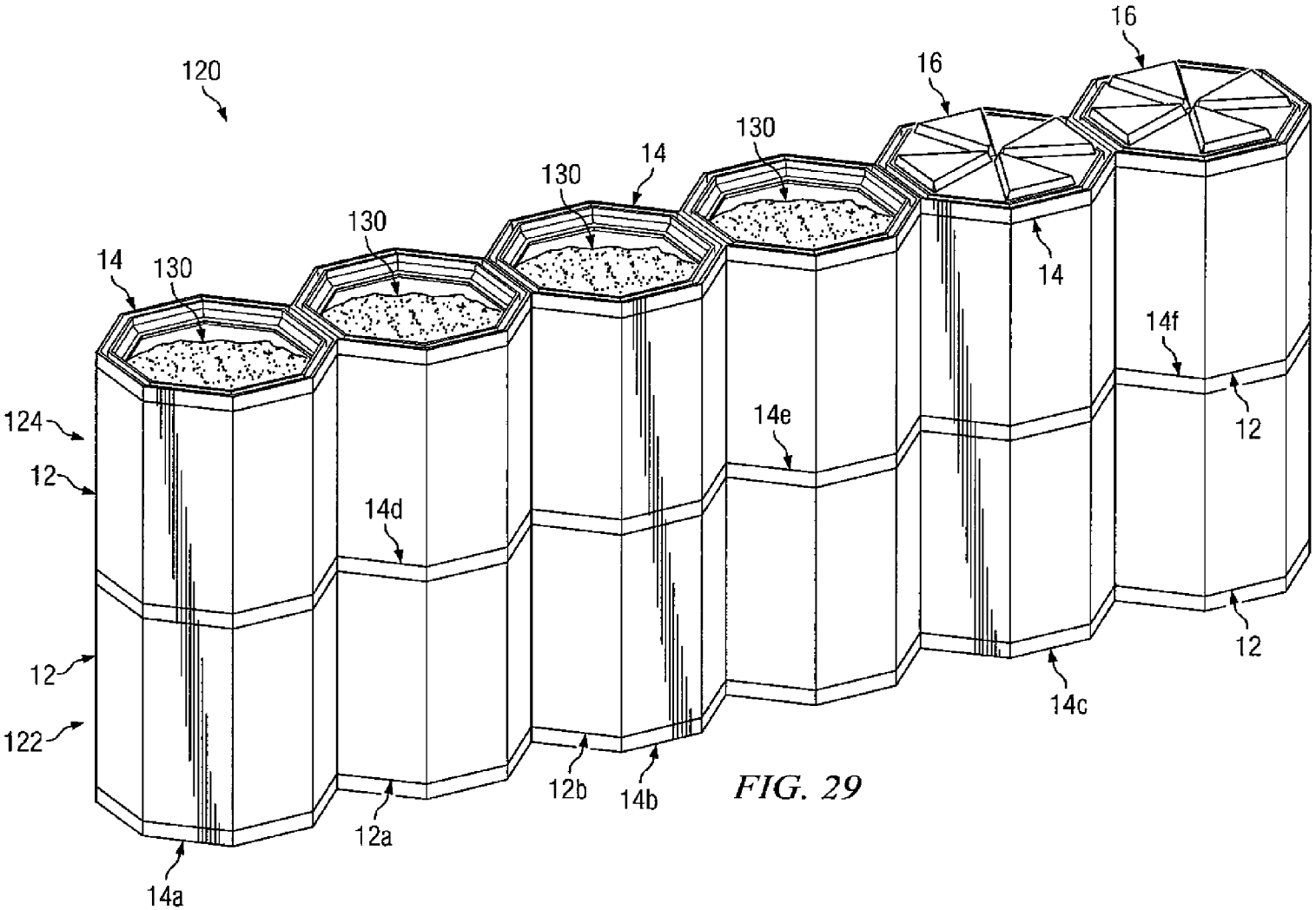
FIG. 29 is a perspective view of the structure shown in FIG. 28, with the structure assembled and with three base members and two caps added to the upper course of the structure, with certain elements of the construction block components omitted for ease of illustration.

FIG. 28 illustrates an exploded view of a structure 120, and FIG. 29 is an assembled view of structure 120. Structure 120 can be constructed from components of construction block 10, for example side wall assemblies 12, base members 14, and caps 16. Structure 120 can include a lower, first course or row 122, and a second, upper course or row 124 positioned on top of the lower course 122. Each of the courses 122 and 124 can include a plurality of base members 14 and a plurality of side wall assemblies 12. Each end of each of the courses 122 and 124 can include a single side wall assembly 12 that is not connected to the adjacent side wall assembly 12. Each side wall assembly 12 that is positioned between each end of each course 122 and 124 can be connected to an adjacent one of the side wall assemblies 12, for example by using a plurality of the links 52, to create connected pairs of the side wall assemblies 12. Each hollow load chamber 18 of the upper course 124 can communicate with an aligned one of the hollow load chambers 18 of the lower course 122.

As shown in FIG. 28, the lower course 122 can include one or more of the inverted caps 16, with each of the inverted caps 16 releasably engaging, and nested within, a respective one of the base members 14. Each of the courses 122 and 124 can be constructed such that each of the connected pairs of side wall assemblies 12 within each of the courses 122 and 124 can engage a pair of adjacent lower base members 14 and/or a pair of adjacent upper base members 14. For example, side wall assemblies 12*a* and 12*b* of course 122 can be connected to one another and side wall assembly 12*a* can be releasably engaged with base member 14*a*, with side wall assembly 12*b* being releasably engaged with base member 14*b*, which is adjacent to base member 14*a*. Also, side wall assembly 12*a* can be releasably engaged with base member 14*d* and side wall assembly 12*b* can be releasably engaged with base member 14*e*, which is adjacent to base member 14*d*. This interconnection between the side wall assemblies 12 and base members 14 can permit the structure 120 to flex or deflect as a unit, which can be advantageous, for example to attenuate a blast wave. In structure 120, base members 14*d*, 14*e* and 14*f* can function as upper base members 14 of the lower course 122 and lower base members 14 of the upper course 124. Various features of the construction block components have been omitted in FIGS. 28 and 29 for clarity of illustration. For example, the ribs 80 and guides 82 of base members 14, and the female hinge members 40, 42 and male hinge members 44 of side wall assemblies 12, have been omitted.

The hollow load chambers 18 of each side wall assembly 12, within each of the courses 122 and 124 can be filled with a ballast material 130, as shown in FIG. 29 with respect to the hollow load chambers 18 of four of the side wall assemblies 12 of the upper course 124. FIG. 29 also illustrates course 124 with a plurality of upper ones of the base members 14 and two of the caps 16, disposed in an upright orientation and releasably engaged with one of the upper base members 14. Ballast material 130 can be a wide variety of materials. Although, the load chambers of construction blocks and structures according to the inventive principles can be filled with concrete, other ballast materials can be used to fill the load chambers that may not require a cure time and which can be less expensive and easier to obtain. In fact, virtually any material can be used as a ballast material to fill the load chambers, including those that are readily available on site. Accordingly, it is not necessary to locate or manufacture special ballast material. Examples of ballast material that can be used to fill the hollow load chambers, such as hollow load chambers 18, include but are not limited to the following materials: dirt, sand, mud, salt, gravel, rocks, ice, snow, water, ceramics, and stabilized injectable aluminum foam such as Cymat™. Also, pumice or other extinguishing materials can be used as ballast material to provide protection against fire balls from a blast. As may be appreciated, the hollow load chambers can be filled with the foregoing, or other, ballast materials without the use of machinery, if none is readily available.

Base member 14 can be formed as a unitary structure using a wide variety of processes, for example by injection molding, thermoforming, or extrusion. Similarly, cap 16 can be formed as a unitary structure using a wide variety of processes, for example by injection molding, thermoforming, or extrusion. Base member 14 and cap 16 can each be made from a thermoplastic material. Base member 14 and cap 16 can each be made of any of the materials discussed previously that can be used to make the panels 20 of side wall assembly 12. The modular components of construction blocks such as those described herein, e.g., side wall assembly 12, base member 14 and cap 16 of construction block 10, can be arranged in any of a variety of configurations and can be used to create any of a variety of walls, revetments and other structures, wherein such structures can include one or more walls that are angled relative to one another. Such construction blocks and structures can be used in any of a variety of applications, including any of the military, government or private sector applications described with respect to the construction blocks and structures disclosed in U.S. patent application Ser. No. 11/945,820, "Construction Block", filed Nov. 27, 2007, published on Jul. 3, 2008 as Publication No. US 2008/0155929 A 1, which is expressly incorporated by reference herein in its entirety. Construction blocks and structures such as those disclosed herein, can include or provide many advantageous features, e.g. superior blast mitigation and ballistic protection features, as well as other features, some of which are described in Publication No. US 2008/0155929 A1 with respect to the construction blocks and structures disclosed therein.

Utilization of construction blocks according to the inventive principles, e.g. construction block 10, as well as structures constructed using modular components of construction blocks according to the inventive principles, e.g., structure 120, can result in additional advantages. For example, the releasable engagement of the notches 34 of the end flanges 32 of panels 20 of side wall assemblies 12 with respective ones of the ribs 80 of each respective base member 14 can facilitate positioning the side wall assemblies 12 relative to the base members 14 and can facilitate a secure and releasable engagement of the side wall assemblies 12 with the base members 14. The positioning and releasable engagement of the side wall assemblies 12 with the base members 14 can be further enhanced with the releasable engagement of indentations 36 of the end flanges 32 of panels 20, with mating ones of the protrusions 88 of base member 14. The use of guides 80, which each can include a sloped surface 84 can facilitate the assembly of panels 20 with each respective base member 14. The spacing between guides 82 and perimeter flange 62 or connecting flange 66 can be selected such that a relatively snug fit can exist between the end flanges 32 of panels 20 and the respective one of the perimeter flange 62 and connecting flange 66 of base member 14 to enhance the structural integrity of construction block 10 or structures made from components of construction block 10.

The versatility of caps 16 reduces the number of components of construction block 10, and therefore the manufacturing costs associated with construction block 10 and/or structures constructed from components of construction block 10. Caps 16 can be disposed in an upright orientation and releasably engaged with the upper one of the base members 14 of construction block 10, or the upper base members 14 of the upper course of a structure, to prevent unwanted material from entering the hollow load chambers 18 of construction block 10, or the hollow load chambers 18 of the upper course of the structure. Also, caps 16 can be disposed in an inverted orientation and releasably engaged with the lower one of the base members 14 of construction block 10 or the base members 14 of a lower course of a structure, to retain ballast material within the hollow load chambers 18 of construction block 10 or the hollow load chambers 18 of the lower course of the structure. The mating indentations 98 of caps 16 and tabs 93 of base member 14 can facilitate the positioning of caps 16 with base member 14 and can facilitate a secure and releasable engagement of the caps 16 with base member 14. The complementary shape of the sloped surfaces 110 of protrusions 106 of caps 16, and the downwardly sloped portions of the inner portions 69, 70 of base member 14 can further facilitate the releasable engagement of inverted caps 16 with base member 14.

While the inventive principles have been illustrated by the description of various embodiments thereof, and while the embodiments have been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A construction block comprising:

a pair of base members, each of the base members defining a first upper channel and a second upper channel, each of the base members comprising a first plurality of ribs positioned within the first upper channel and a second plurality of ribs positioned within the second upper channel; and a pair of side wall assemblies, each of the side wall assemblies comprising a plurality of hingedly interconnected panels, each of the panels of each of the side wall assemblies comprising a thermoplastic material, each of the side wall assemblies defining a hollow load chamber having an open top and an open bottom; wherein a first one of the side wall assemblies is releasably engaged with at least some of the first plurality of ribs of a lower one of the base members, and a second one of the side wall assemblies is releasably engaged with at least some of the second plurality of ribs of the lower one of the base members; and each of the first one of the side wall assemblies and the second one of the side wall assemblies is releasably engaged with an upper one of the base members.

2. The construction block of claim 1, further comprising:

at least one cap; wherein the at least one cap is releasably engaged with one of the base members.

3. The construction block of claim 2, wherein:

the at least one cap comprises a first cap and a second cap, each of the first cap and the second cap being releasably engaged in an upright orientation with the upper one of the base members; and each of the first and second caps is configured to at least substantially prevent communication between the hollow load chamber of a respective one of the side wall assemblies and an environment exterior of the construction block.

4. The construction block of claim 3, further comprising:

a third cap and a fourth cap, each of the third cap and the fourth cap being releasably engaged in an inverted orientation with the lower one of the base members; wherein each of the third cap and the fourth cap is configured to facilitate retaining a ballast material within the hollow load chamber of a respective one of the side wall assemblies.

5. The construction block of claim 1, wherein:

each of the base members defines a first aperture and a second aperture;

the first aperture of the lower one of the base members and the first aperture of the upper one of the base members each communicates with the hollow load chamber of the first one of the side wall assemblies; and the second aperture of the lower one of the base members and the second aperture of the upper one of the base members each communicates with the hollow load chamber of the second one of the side wall assemblies.

6. The construction block of claim 1, wherein:

each of the base members of the pair of base members further comprises a perimeter flange, a first inner flange, a second inner flange and a web member, the web member being integral with, and transverse to, each of the perimeter flange, the first inner flange and the second inner flange;

for each of the base members of the pair of base members, the perimeter flange cooperates with the first inner flange and the web member to at least partially define the first upper channel; and for each of the base members of the pair of base members, the perimeter flange cooperates with the second inner flange and the web member to at least partially define the second upper channel.

7. The construction block of claim 1, wherein:

each of the panels of each of the side wall assemblies of the pair of side wall assemblies comprises a lower end flange defining a first plurality of notches and an upper end flange defining a second plurality of notches;

at least some of the first plurality of notches of the lower end flange of at least some of the panels of the first one of the side wall assemblies releasably engage a respective one of the first plurality of ribs of the lower one of the base members; and at least some of the first plurality of notches of the lower end flange of at least some of the panels of the second one of the side wall assemblies releasably engage a respective one of the second plurality of ribs of the lower one of the base members.

8. The construction block of claim 1, wherein:

each of the base members of the pair of base members comprises a perimeter flange having an outer surface;

each of the panels of each of the side wall assemblies comprises a first side, a second side, a central portion, a lower end flange and an upper end flange;

the central portion of each of the panels of each of the side wall assemblies has a generally planar outer surface;

the central portion of each of the panels of each of the side wall assemblies extends between the respective lower and upper end flanges and between the respective first and second sides;

each of the lower end flange and the upper end flange of each of the panels of each of the side wall assemblies is offset inwardly from the generally planar outer surface of the central portion of the respective panel, such that the generally planar outer surface of at least some of the panels of the first side wall assembly and the generally planar outer surface of at least some of the panels of the second side wall assembly are at least substantially flush with the outer surface of the perimeter flange of each of the base members.

9. The construction block of claim 7, wherein:

each of the base members of the pair of base members further defines a first lower channel and a second lower channel and further comprises a third plurality of ribs positioned within the first lower channel, and a fourth plurality of ribs positioned within the second lower channel; and the first one of the side wall assemblies is releasably engaged with at least some of the third plurality of ribs of the upper one of the base members, and the second one of the side wall assemblies is releasably engaged with at least some of the fourth plurality of ribs of the upper one of the base members.

10. The construction block of claim 9, wherein:

at least some of the second plurality of notches of the upper end flange of at least some of the panels of the first one of the side wall assemblies releasably engages a respective one of the third plurality of ribs of the upper one of the base members; and at least some of the second plurality of notches of the upper end flange of at least some of the panels of the second one of the side wall assemblies releasably engages a respective one of the fourth plurality of ribs of the upper one of the base members.

11. The construction block of claim 9, wherein:

each of the base members of the pair of base members further comprises a first plurality of guides positioned within the first upper channel, a second plurality of guides positioned within the second upper channel, a third plurality of guides positioned within the first lower channel, and a fourth plurality of guides positioned within the second lower channel;

each one of the first plurality of guides of the lower one of the base members is configured to facilitate assembly of the first one of the side wall assemblies with the lower one of the base members;

each one of the second plurality of guides of the lower one of the base members is configured to facilitate assembly of the second one of the side wall assemblies with the lower one of the base members;

each one of the third plurality of guides of the upper one of the base members is configured to facilitate assembly of the first one of the side wall assemblies with the upper one of the base members; and each of the fourth plurality of guides of the upper one of the base members is configured to facilitate assembly of the second one of the side wall assemblies with the upper one of the base members.

12. The construction block of claim 1, further comprising:

a plurality of links, each of the links having a pair of apertures; wherein one of the panels of the first one of the side wall assemblies is connected to one of the panels of the second one of the side wall assemblies with the plurality of links.

13. The construction block of claim 8, wherein when viewed in transverse cross-section:

the generally planar outer surfaces of the central portions of the panels of the first one of the side wall assemblies cooperate to define a first polygon; and the generally planar outer surfaces of the central portions of the panels of the second one of the side wall assemblies cooperate to define a second polygon, the second polygon being the same as the first polygon.

14. A construction block comprising:

a pair of base members, each of the base members defining a first upper channel, a second upper channel, a first lower channel and a second lower channel, each of the base members comprising a first plurality of ribs positioned within the first upper channel, a second plurality of ribs positioned within the second upper channel, a third plurality of ribs positioned within the first lower channel and a fourth plurality of ribs positioned within the second lower channel; and a pair of side wall assemblies connected to one another, each of the side wall assemblies comprising a plurality of interconnected panels, wherein, for each of the side wall assemblies, each of the panels comprises a thermoplastic material and is hingedly connected to each adjacent one of the panels of a respective one of the side wall assemblies, each of the side wall assemblies defining a hollow load chamber having an open top and an open bottom, at least some of the panels of each of the side wall assemblies being angled relative to one another; wherein each of the panels of each of the side wall assemblies comprises a lower end flange and an upper end flange;

the lower end flange of each of the panels of a first one of the side wall assemblies is positioned at least partially within the first upper channel of a lower one of the base members and is releasably engaged with at least one of the first plurality of ribs of the lower one of the base members;

the lower end flange of each of the panels of a second one of the side wall assemblies is positioned at least partially within the second upper channel of the lower one of the base members and is releasably engaged with at least one of the second plurality of ribs in the lower one of the base members;

the upper end flange of each of the panels of the first one of the side wall assemblies is positioned at least partially within the first lower channel of the upper one of the base members and is releasably engaged with at least one of the third plurality of ribs of the upper one of the base members; and the upper end flange of each of the panels of the second one of the side wall assemblies is positioned at least partially within the second lower channel of the upper one of the base members and is releasably engaged with at least one of the fourth plurality of ribs of the upper one of the base members.

15. The construction block of claim 14, wherein:

each of the base members of the pair of base members further comprises a perimeter flange, a first inner flange, a second inner flange and a web member;

for each of the base members of the pair of base members, the perimeter flange cooperates with the first inner flange and the web member to at least partially define the first upper channel and to at least partially define the first lower channel; and for each of the base members of the pair of base members, the perimeter flange cooperates with the second inner flange and the web member to at least partially define the second upper channel and to at least partially define the second lower channel;

at least some of the first plurality of ribs and at least some of the third plurality of ribs extend between the perimeter flange and the first inner flange; and at least some of the second plurality of ribs and at least some of the fourth plurality of ribs extend between the perimeter flange and the second inner flange.

16. The construction block of claim 15, further comprising:

a first cap, a second cap, a third cap and a fourth cap; wherein each of the first cap and the second cap is releasably engaged in an upright orientation with the upper one of the base members; and each of the third cap and the fourth cap is releasably engaged in an inverted orientation with the lower one of the base members.

17. The construction block of claim 16, wherein:

each of the base members of the pair of base members further comprises a first plurality of guides positioned within the first upper channel and a second plurality of guides positioned within the second upper channel, each of the first plurality of guides of each of the base members and each of the second plurality of guides of each of the base members having a sloped upper surface;

the first plurality of guides of the lower one of the base members facilitates assembly of the first one of the first side wall assemblies with the lower one of the base members;

the second plurality of guides of the lower one of the base members facilitates assembly of the second one of the side wall assemblies with the lower one of the base members;

each of the base members of the pair of base members further comprises a third plurality of guides positioned within the first lower channel and a fourth plurality of guides positioned within the second lower channel;

for each of the base members, each of the third plurality of guides and each of the fourth plurality of guides has a sloped lower surface;

the third plurality of guides of the upper one of the base members facilitates assembly of the first one of the side wall assemblies with the upper one of the base members; and the fourth plurality of guides of the upper one of the base members facilitates assembly of the second one of the side wall assemblies with the upper one of the base members.

18. The construction block of claim 16, wherein:

each of the panels of each of the side wall assemblies of the pair of side wall assemblies comprises a lower end flange defining a first plurality of notches and an upper end flange defining a second plurality of notches;

at least some of the first plurality of notches of the lower end flange of at least some of the panels of the first one of the side wall assemblies releasably engages a respective one of the first plurality of ribs of the lower one of the base members;

at least some of the first plurality of notches of the lower end flange of at least some of the panels of the second one of the side wall assemblies releasably engages a respective one of the second plurality of ribs of the lower one of the base members;

at least some of the second plurality of notches of the upper end flange of at least some of the panels of the first one of the side wall assemblies releasably engages a respective one of the third plurality of ribs of the upper one of the base members; and at least some of the second plurality of notches of the upper end flange of at least some of the panels of the second one of the side wall assemblies releasably engages a respective one of the fourth plurality of ribs of the upper one of the base members.

19. A structure made from a kit of construction block components, the kit comprising:

a plurality of base members; and a plurality of side wall assemblies; wherein each of the base members defines a first upper channel, a second upper channel, a first lower channel and a second lower channel, each of the base members comprising a first plurality of ribs positioned within the first upper channel, a second plurality of ribs positioned within the second upper channel, a third plurality of ribs positioned within the first lower channel and a fourth plurality of ribs positioned within the second lower channel;

each of the side wall assemblies comprises a plurality of hingedly interconnected panels, each of the panels comprising a thermoplastic material, each of the side wall assemblies being movable between a collapsed configuration and an erected configuration, wherein each of the side wall assemblies define, in the erected configuration, a hollow load chamber having an open top and an open bottom;

the structure comprises a base course comprising a first plurality of the base members disposed adjacent to one another;

the base course of the structure further comprises a first plurality of the side wall assemblies in the erected configuration;

each of the first plurality of the erected side wall assemblies releasably engages a respective one of the first plurality of the base members and extends upwardly therefrom; and at least some of the first plurality of ribs and at least some of the second plurality of ribs of each of the first plurality of the base members releasably engages a respective one of the first plurality of the erected side wall assemblies.

20. The structure of claim 19, wherein:

the kit further comprises a plurality of caps;

the structure further comprises a second course vertically adjacent to and releasably engaged with the base course;

the second course comprises a second plurality of the side wall assemblies in the erected configuration, and a second plurality of the base members positioned vertically between the first plurality of the erected side wall assemblies and the second plurality of the erected side wall assemblies;

at least some of the third plurality of ribs and at least some of the fourth plurality of ribs of each of the second plurality of the base members releasably engages a respective one of the first plurality of the erected side wall assemblies of the base course;

at least some of the first plurality of ribs and at least some of the second plurality of ribs of each of the second plurality of the base members releasably engages a respective one of the second plurality of the erected side wall assemblies of the second course; and at least some of the caps are releasably engaged in an inverted orientation with a respective one of the first plurality of the base members of the base course.

* * * * *

UNITED STATES PATENT AND TRADEMARK OFFICE

CERTIFICATE OF CORRECTION

PATENT NO. : 8,209,916 B2
APPLICATION NO. : 12/505956
DATED : July 3, 2012
INVENTOR(S) : Burke A. Herron It is certified that error appears in the above-identified patent and that said Letters Patent is hereby corrected as shown below:

Column 1, line 65, after "within", insert -- the first upper channel and a secondary plurality of ribs positioned within the second upper channel. The construction block also includes a pair of side wall assemblies. Each of the side wall assemblies includes a plurality of hingedly interconnected panels. Each of --;
Column 5, line 65, replace "side wail assembly" with -- side wall assembly --;
Claim 10, Column 18, line 4, replace "engages" with -- engage --;
Claim 10, Column 18, line 9, replace "engages" with -- engage --;
Claim 18, Column 20, line 31, replace "engages" with -- engage --;
Claim 18, Column 20, line 36, replace "engages" with -- engage --;
Claim 18, Column 20, line 41, replace "engages" with -- engage --;
Claim 18, Column 20, line 46, replace "engages" with -- engage --;
Claim 19, Column 21, line 16, replace "engages" with -- engage --;
Claim 20, Column 22, line 9, replace "engages" with -- engage --; and
Claim 20, Column 22, line 14, replace "engages" with -- engage --.

Signed and Sealed this
Ninth Day of October, 2012

David J. Kappos

David J. Kappos
*Director of the United States Patent and Trademark Office*